US005556100A

United States Patent [19]

Taylor et al.

[11] Patent Number: 5,556,100

[45] Date of Patent: Sep. 17, 1996

[54] GAME OF THE IMMUNE SYSTEM

[75] Inventors: Mark F. Taylor; Sally W. Jackson, both of Waco, Tex.

[73] Assignee: Baylor University, Waco, Tex.

[21] Appl. No.: 455,644

[22] Filed: May 31, 1995

[51] Int. Cl.[6] ..... A63F 3/00

[52] U.S. Cl. ..... 273/249

[58] Field of Search ..... 273/236, 242, 273/243, 248, 249

[56] References Cited

U.S. PATENT DOCUMENTS

| | | | |
|---|---|---|---|
| 3,936,054 | 2/1976 | Garcia | 273/134 |
| 4,136,879 | 1/1979 | Andrew et al. | 273/243 |
| 4,344,625 | 8/1982 | Frudakis | 273/249 X |
| 4,372,559 | 2/1983 | Summers | 273/243 |
| 4,718,675 | 1/1988 | Rosenberg et al. | 273/243 |
| 5,062,645 | 11/1991 | Goodman et al. | 273/249 |
| 5,211,402 | 5/1993 | Ferguson et al. | 273/249 |
| 5,215,309 | 6/1993 | Joel | 273/243 |
| 5,228,860 | 7/1993 | Hale | 273/243 X |
| 5,295,834 | 3/1994 | Saunders | 434/128 |

*Primary Examiner*—William E. Stoll
*Attorney, Agent, or Firm*—Arnold White & Durkee

[57] ABSTRACT

The present invention provides a board game for use as a didactic teaching-aid for individuals that are interested in the immune system. The game comprises a playing board having a continuous main course having a plurality of playing spaces. Each playing space contains a number that matches the number of an immune scenario vignette that constitutes an exposure to an infectious disease or to an immune disease state, such as an auto-immune disease or an immune-deficiency. A method of curing or treating the disease, and information about the disease is provided in a disease handout that the players reference while tending to their disease at a hospital, clinic or pharmacy, depending on the nature of the exposure. When a player attains immunity, they become immune to those diseases that are subsequently encountered.

16 Claims, 16 Drawing Sheets

BLOOD TYPES

Players roll the die two times to determine blood type at the start of the game and later for types given in transfusion.

| Sum of 2 rolls | Blood Type | Can give to | Can Receive From |
|---|---|---|---|
| 2 or 3 | O+ | ANY "+" | O+, O- |
| 4 or 5 | A+ | A+, AB+ | ANY A OR O |
| 6 or 7 | B+ | B+, AB+ | ANY B OR O |
| 8 | AB+ | AB+ | ANY TYPE |
| 9 | O- | ANY TYPE | O- |
| 10 | A- | ANY A OR B | A-, O- |
| 11 | B- | ANY B OR AB | B-, O- |
| 12 | AB- | AB-, AB+ | ANY "-" |

HIV CARD

The holder of this card must give up at least half of their lymphocyte cards each time they pass a "Clinic" or "Hospital" they have not passed before

GAME OF THE IMMUNE SYSTEM

BACKGROUND OF THE INVENTION

1. Field of the Invention

The present invention relates generally to the fields of teaching and the use of didactic aids for exemplifying various scenarios related to the immune system. More particularly, it concerns the use of a board game to aid in teaching the art of immunology to students of biology and the health professions.

2. Description of the Related Art

With the increase of AIDS in recent years, much more attention is being paid to the body's immune system. People are becoming knowledgeable about how the human immunodeficiency virus (HIV) can adversely affect the body's ability to defend itself against a wide variety of pathogens. As more students are contemplating the pursuit of a career in the medical or allied health professions, they may be required to take courses in anatomy, physiology, microbiology, or other biological sciences.

Often the topic of the immune system is covered in a lecture situation and/or a video, but is ignored in the laboratory. This may be due to the restrictions on using pathogens or body fluids, and/or having limited facilities or funds. Since the immune system is a functional system, as opposed to a strictly anatomical system, it may be covered only briefly in an introductory biology or human anatomy and physiology course, most often in combination with the lymphatic system.

Complete background information related to the immune system is available from several sources (Benjamini and Leskowitz, 1991; Brock et al., 1994; Tizard, 1992). The immune system is referred to as a "specific" defense mechanism since it utilizes certain white blood cells, called lymphocytes, which have the ability to recognize and remember specific pathogens.

Several educational devices have been developed for teaching various subjects within the allied health field. These include a game as shown in U.S. Pat. No. 4,121,823 to Hale, which is a game depicting HIV (human immunodeficiency virus) and the progression of AIDS (acquired immune deficiency syndrome). Players move around a board, become "infected" with HIV, and eventually expire. Cards provide facts related to AIDS and terminal medical events.

U.S. Pat. No. 5,215,309 to Joel is an educational health game where players move along a path and draw cards upon which questions may be asked or health problems may be acquired. A player having a particular health certificate may avoid certain acquired health problems.

U.S. Pat. No. 4,372,559 to Summers describes a board game to teach student nurses or graduate nurses, wherein players move along a path, draw cards, and questions are answered to determine further movement along the path.

Due to the lack of hands-on activities for teaching the immune system, a need exists for a training system that reinforces concepts discussed in lecture classes concerning the immune system.

SUMMARY OF THE INVENTION

In a broad aspect, the present invention concerns the use of a game to teach people about the immune system. One feature of the game is to advance a token through a variety of predetermined game scenarios. Each scenario provides a small disease vignette that exemplifies the encounter of the host (or player) with the particular disease. In order to advance, the player responds to the encounter by following the instructions recited in the vignette, thereby learning about the host immune response to the particular disease and also about the present treatment options (if available) to the encounter.

The instant invention enables a person to learn about the more commonly-known human diseases and ailments that are combatted by the immune system, and about some of the allergic reactions that occur as a result of the immune system. In addition, some diseases for which the immune system does not provide long-lasting or protective immunity are included, such as staphylococcal skin infections and strep throat.

An important aspect of the board game of the invention deals with the acquisition of specific immunity to a particular disease, or antigen. This immunity is provided through the acquisition of "helper" T cell or immune cards, wherein the player becomes immune to the particular scenario for which such immunity is available. Acquisition of an immune card provides the player with protection from the consequences of a disease for the duration of the game, reflecting a natural host immune response to those diseases for which immunity is life-long.

Present medical technology provides numerous means for addressing disease states by prevention (as in the case of vaccines), treatment (antibiotics), or even letting the disease run its course while treating the symptoms (e.g. the common cold). The board game provides for added realism in the form of institutions such as hospitals and pharmacies for treatment of disease states. When players fall victim to a particular disease, they are remanded to such a facility for a predetermined duration, reflecting the severity of the disease in the form of lost turns. The game even provides for hospital and pharmacy overcrowding, thereby forcing players to move to the nearest available facility.

The apparatus of the present invention comprises a playing board having a continuous main course. The main course preferably contains a representation of an immune related molecule on which distinctive tokens are advanced from a defined starting point to a defined ending point through a plurality of playing spaces. A disease handout is provided to the pupils for use in preparing for the game. The handout sets forth particular immunological scenarios, including the symptoms, course, and treatment of particular disorders.

In a preferred embodiment of the invention the playing board has a continuous main course where the main course is in the shape of, for example, an immunoglobulin (antibody) molecule that is divided into a plurality of adjacent playing spaces. Other immune specific or related molecules may be used instead of an immunoglobulin molecule, for example a T cell receptor, a co-stimulatory molecule such as CD28, an interleukin receptor, and the like that will be known to those of skill in the art. In a preferred embodiment of the present invention, the main course of the board is in the shape of an immunoglobulin molecule, with an immunoglobulin (Ig) of the IgG isotype being particularly preferred.

The main course includes playing spaces and rest spaces. The playing spaces of the board have numbers in a random order printed in each space that correspond to a specific immunological scenario. Immune scenarios are provided, for example in a handout, as part of the game; they may be varied to emphasize certain infectious diseases, disease states, and the like. The immune scenarios may also be adapted to the relative knowledge level of the players.

Associated with the playing spaces are rest spaces that correspond to a clinic, a pharmacy, or a hospital. These features represent a clinical response to the immune scenario, wherein the player must stop to treat or cure an infection, allow the disease to progress, receive a vaccine, or the like in order to respond to the scenario. Still further spaces are provided at the terminal ends of the game board designated as start and end spaces.

The playing board may also comprise diagrams showing hypothetical shapes representing, for example, certain bacterial and viral surfaces that may be encountered during the game. These shapes may be varied depending on the relative knowledge level of the players and the particular teaching emphasis. The game board may also have three-dimensional shapes for antigens, such as bacteria or viruses, into which a player's acquired antibody molecules (also three-dimensional) can interlock, thus giving the player immunity against that particular antigen.

The game board surface may also provide a table showing blood types and a number required to determine the blood type by matching the outcome of a chance event delivered by a chance device. The determination of blood type represents a means of teaching the importance of host versus graft responses. It is contemplated, for example, that more advanced players may receive predetermined Major Histocompatibility haplotypes for use in determining graft rejection, propensity for auto-immune disorders and the like.

An important aspect of the invention lies in a plurality of cards, with each card corresponding to a specific helper T cell that can interlock with a specific bacterial or viral pathogen encountered during the course of the game. The shapes of the T cell receptor (TCR) on each card may correspond to the shapes of the specific bacteria and viruses located along the edge of the game board. The cards are used to show that the specific shape of the TCR determines which specific antigen that a $T_H$ cell may react with. These cards identify the diseases that the individual player has encountered and for which the player has attained immunity.

A further aspect of the present invention concerns a chance device capable of being actuated by a player to determine the number of spaces to be moved by the player as well as to determine the blood group type at the beginning of the game. As disclosed herein, a "chance device" is any device such as a die or dice, a spinning pointer, or other random number generator. In a preferred embodiment of the present invention the chance device is a die. In an even more preferred embodiment the die is six-sided. In an alternative embodiment the chance device is a rotatable pointer connected to a printed surface having a plurality of numbers, with six numbers being particularly preferred. The game also provides for a plurality of distinctive tokens constituting playing pieces, for each of the individual players or player teams to utilize while playing the game.

A particularly important aspect of the present invention resides in a "disease handout" comprising a list of various immunological scenarios related to diseases and allergies that involve the immune system, with descriptions of the diseases, disease states, allergies, as well as the type of immune response mourned against the disease, if so applicable. It is an important feature of the invention that the disease handout match each disease or allergy by number, corresponding to a numbered space on the game board. The "disease handout" is given to the players a few days prior to a game, or it may be provided with the game. More detailed information that provides the basis for this handout can be found in several texts (Brooks et al., 1991; Joklik et al., 1992; Prescott et al., 1993; Tortora et al., 1992).

Another aspect of the disease handout may be a drawing or other representation showing various aspects of the immune system and the immune response. This drawing may include, but is not limited to, a depiction of the interaction between macrophages, helper T ($T_H$) cells, and cytotoxic T ($T_C$) cells.

A preferred method of learning about immunology using the present invention comprises providing a game apparatus having a board whereupon a path is shaped to resemble an antibody or other immunologically active molecule that is divided into a plurality of adjacent playing spaces. A portion of the playing spaces have numbers in a random order printed in each space, corresponding to a specific immunological scenario, and yet another portion of the remaining spaces have rest spaces associated with a clinic, a pharmacy, a hospital, or other medical facility. Further remaining spaces at the terminal ends of the game board are designated as start and end spaces.

Also provided are a plurality of cards, each card corresponding to a helper T cell with a T cell receptor (TCR) that has a shape that can interlock with a specific bacterial or viral pathogen encountered in the game. The shapes on each card must interlock, or be complimentary, to the shapes of the specific antigens (e.g. bacteria and viruses) to which they correspond. The representative shapes of the antigens may be located along the edge of the game board, or may be provided separately.

In certain embodiments, the representative shapes of the antigens and the lymphocyte cards are three dimensional; that is they may be constructed so as to physically interlock with their respective antigens in the manner of a "lock and key." As described herein, the term "interlock" means that a shape representing a particular antigen, for instance a triangle shape, is able to fit only into a corresponding shape that represents a helper T cell with a T cell receptor (TCR) and is the three dimensional version of the lymphocyte card. Further to this embodiment, the antigen shapes may be attached to the game board, or they may be separate pieces. It is contemplated that the three dimensional shapes depicting the antigens, such as bacteria or viruses, and the shapes representing the helper T cell with a T cell receptor (TCR) may be constructed from plastic, wood, metal, or the like.

A chance device capable of being actuated by a player, such as a die or a spin wheel, is used to determine the number of spaces to be moved by the player as well as to determine the blood group type of the player for the duration of the game.

A plurality of distinctive tokens constituting playing pieces is provided for use by the individual players or player groups playing in the game. Each player or playing group has its own token.

Play commences by assigning each player a marker or token, followed by determination of the player's blood group that is ascertained using a chance device. The order of play may be determined by chance by using the chance device to, for example, determine the individual playing order, or the orientation of play (e.g. clockwise). Initially, players advance from the starting point along the adjacent playing spaces according to the numbers generated by the chance device.

Upon landing on any given numbered space, the player is provided a situation identified by the same number enumerated in the immune scenario list, whereupon the player is required to follow directions for a particular immunological scenario in the handout that corresponds to the number of the given space. Players who have received a lymphocyte card specific to a particular pathogen will be protected from the same pathogen in a later exposure means similar to that generally encountered by an immunocompetent host. Rest areas are provided at various locations on the playing board that correspond to hospitals, pharmacies, clinics and the like where players may receive treatment, such as a vaccination or antibiotics, or where a turn may be lost.

As players develop immunity they are able to advance further because they have gained immunity to offending pathogens, provided that they have not succumbed to immune disease states, such as autoimmune diseases, allergies, anaphylaxis, immune deficiencies, and the like. The player or group that advances first to the finish line is the player or group that wins the game. It is proposed that at least one useful incentive for playing the game in a classroom setting may be, for example, to receive credit for winning the game such as extra-credit points on a quiz or exam.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1D is a key of virus types and blood types.

DETAILED DESCRIPTION OF PREFERRED EMBODIMENTS

Figure 1A:
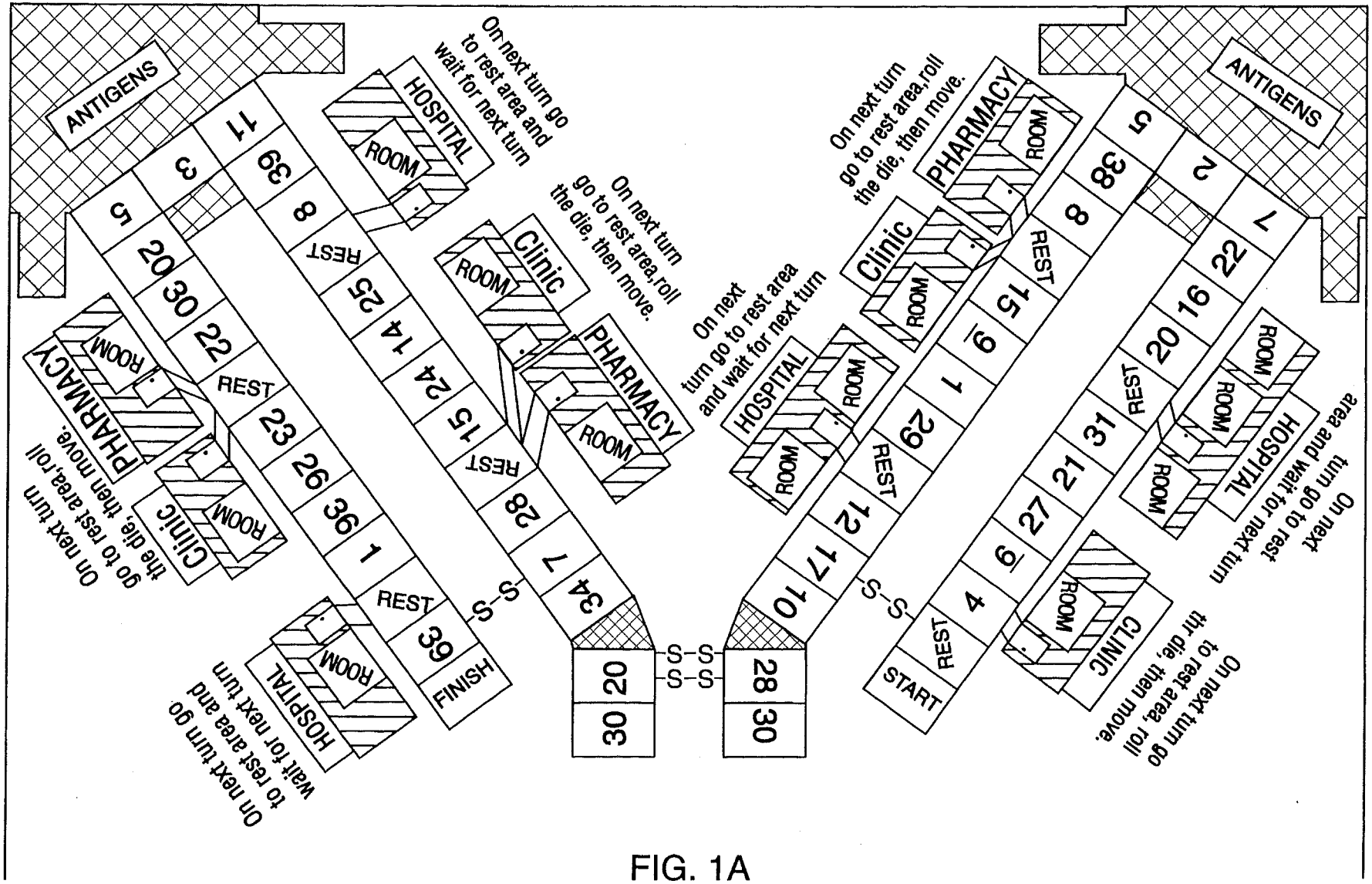
FIG. 1A, FIG. 1B, FIG. 1C, FIG. 1D—The game board. The board used in the classroom measures 18×24 inches and is put together with FIG. 1A positioned adjacent to FIG 1B, and FIG. 1B positioned adjacent to FIG. 1C, such that numbers 30 on FIG. 1A line up with numbers 17 and 3, respectively, on FIG. 1B, and numbers 32 and 11 on FIG. 1B line up with numbers 22 and 28, respectively, at the top of FIG. 1C.
Figure 1B:
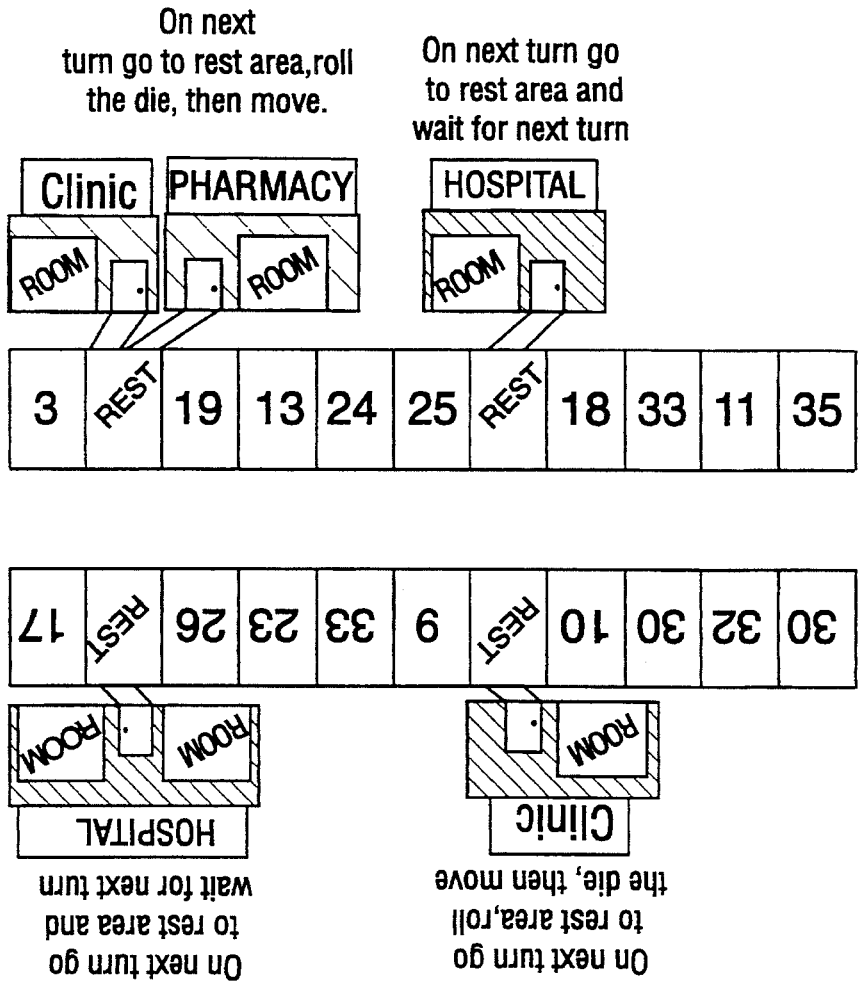
Figure 1C:
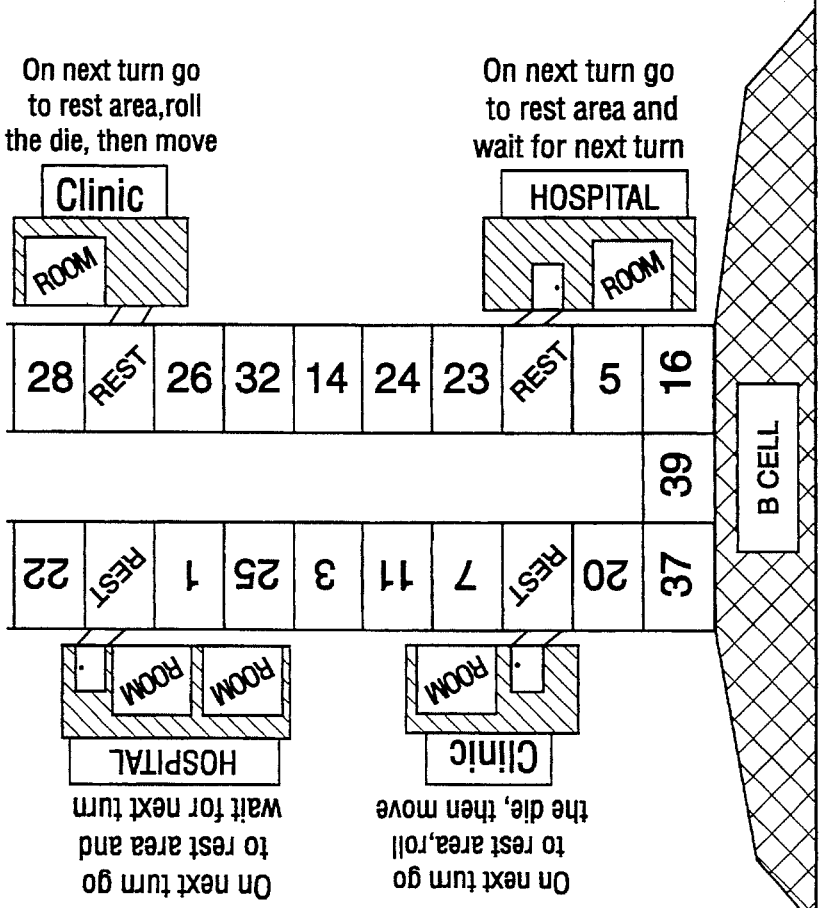
Figure 1D:
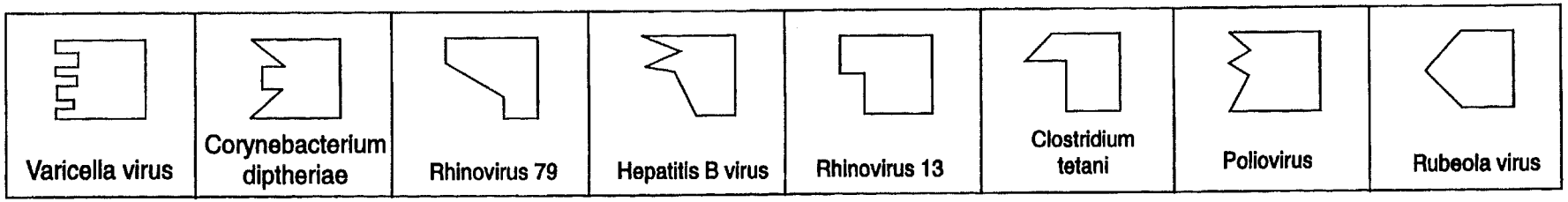
Figure 1D:
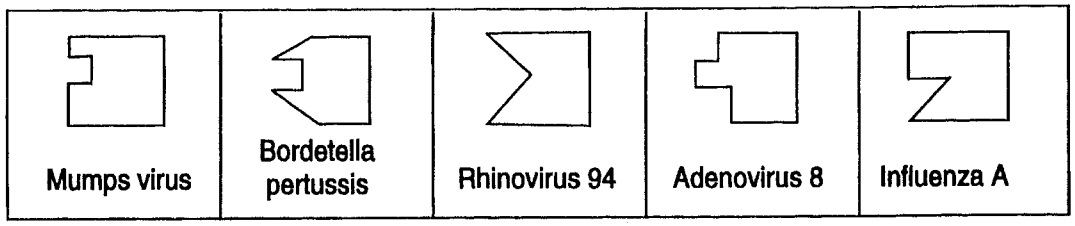
Figure 2A:
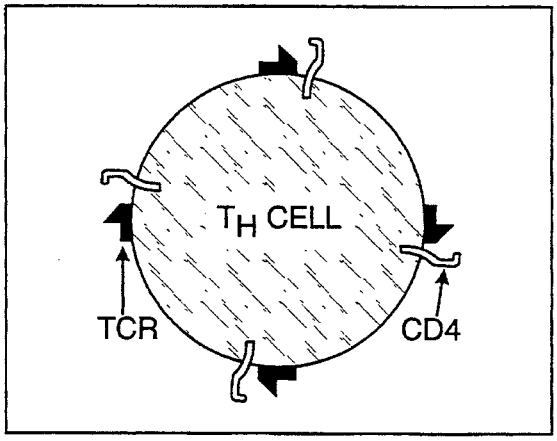
FIG. 2A, FIG. 2B, FIG. 2C, FIG. 2D, FIG. 2E, FIG. 2F, FIG. 2G, FIG. 2H, FIG. 2I, FIG. 2J, FIG. 2K, FIG. 2L, FIG. 2M—Cards showing hypothetical lymphocyte ($T_H$ and B cells) receptor shapes for the various bacterial and viral pathogens encountered in the game. The shapes correspond to the specific bacteria and viruses located along the edge of the game board.
Figure 2B:
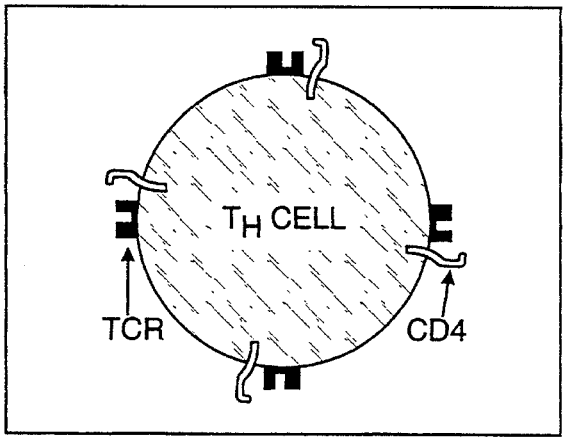
Figure 2C:
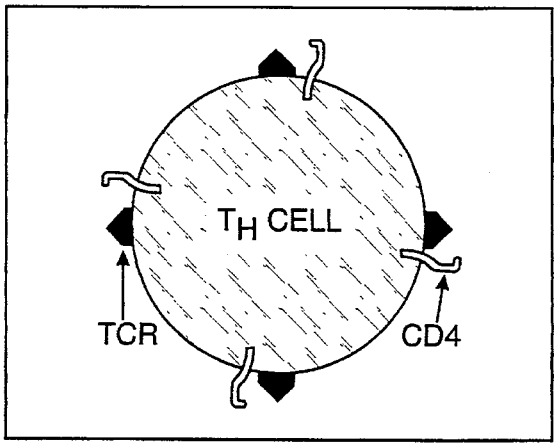
Figure 2D:
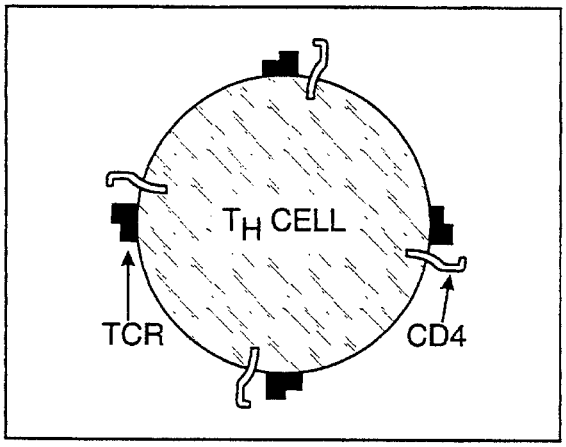
Figure 2E:
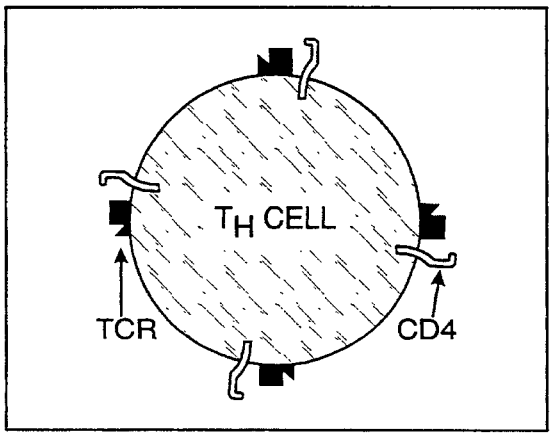
Figure 2F:
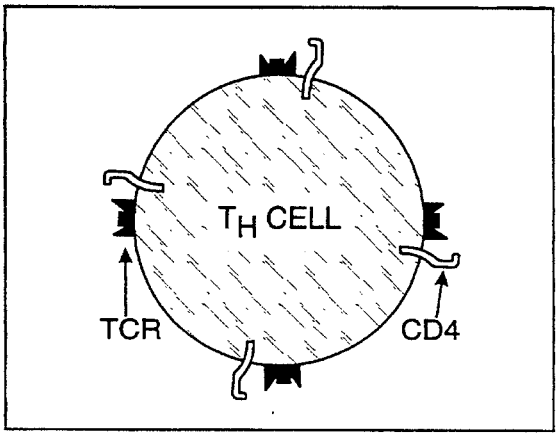
Figure 2G:
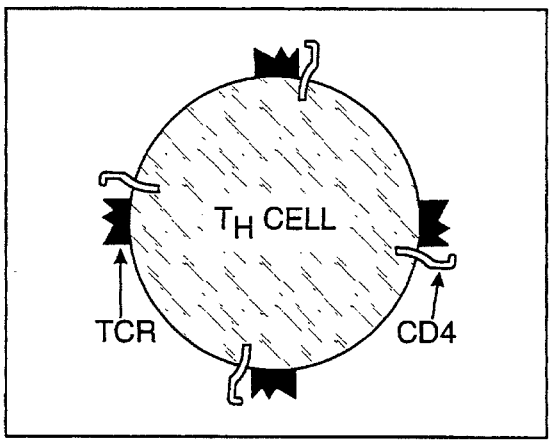
Figure 2H:
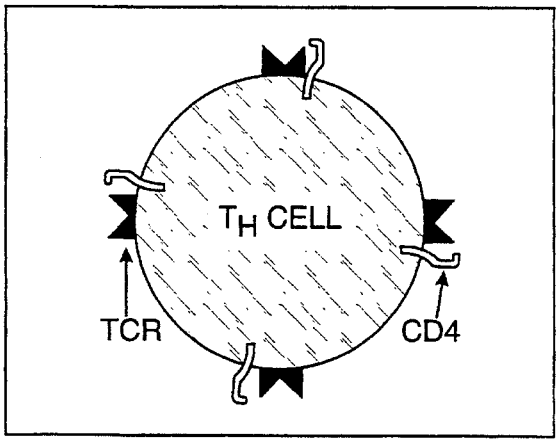
Figure 2I:
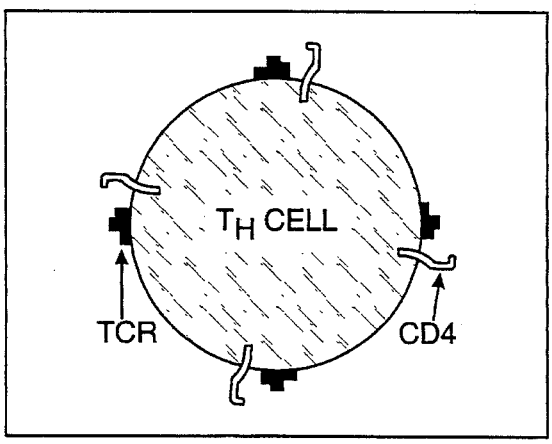
Figure 2J:
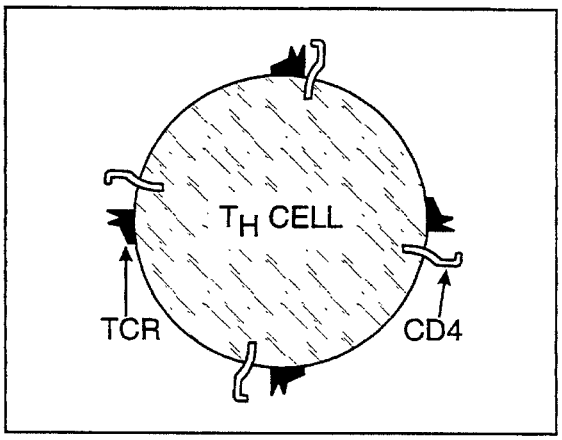
Figure 2K:
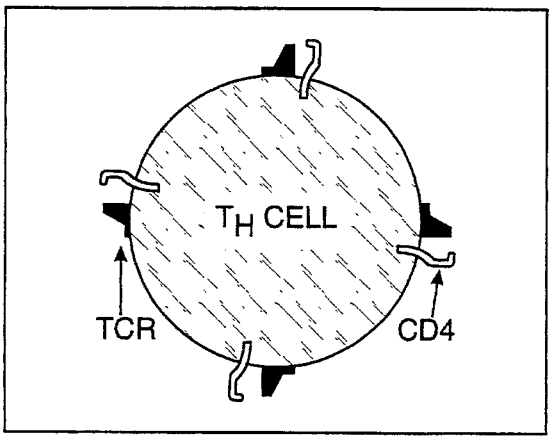
Figure 2L:
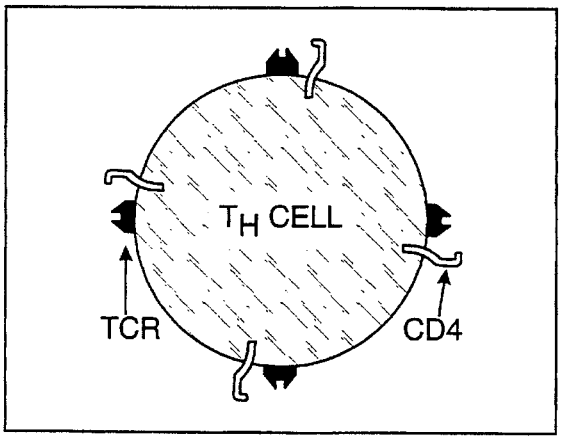
Figure 2M:
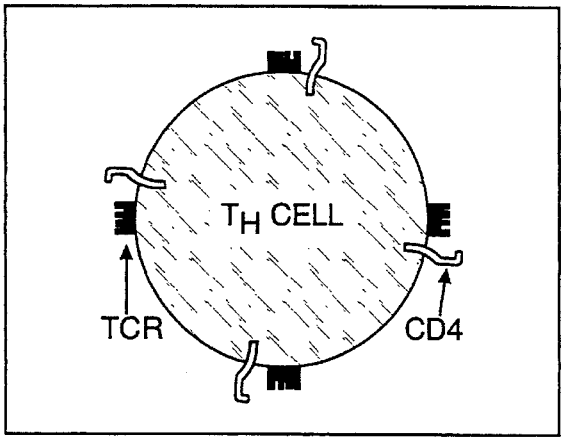
Figure 2N:
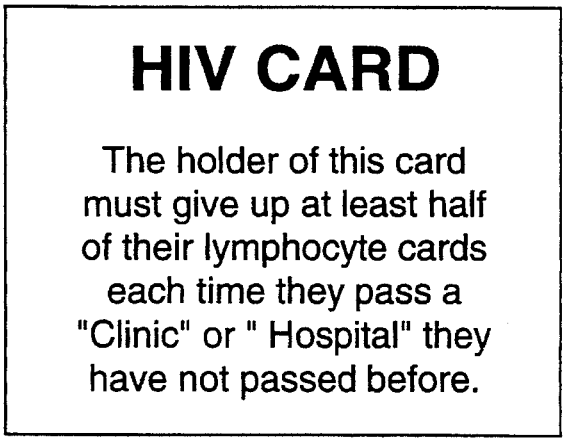
FIG. 2N—Depicts a "HIV" card, describing the actions a player must take upon landing on a space occupied by an individual having HIV.

When a specific pathogen enters the body, it may be phagocytized by a macrophage. The pathogen is then processed, and small potentially immunogenic peptides are transported into the lumen of the endoplasmic reticulum for display on the cell membrane of the macrophage. A T lymphocyte (T helper or $T_H$ cell) specific for the presented antigen that has the ability to recognize this particular antigen will bind with it and become "activated." The activated $T_H$ cell divides rapidly, creating a large number of $T_H$ cells referred to as "clones" of the progenitor T cell. All of the cells within a particular clone lineage can recognize the same antigen. These cells can then activate a variety of other cells, including specific B lymphocytes (B cells), cytotoxic T cells ($T_C$ cells), and delayed type hypersensitivity cells ($T_{DTH}$ cells). Activated B cells differentiate into plasma cells that secrete antibodies, which can either bind to specific pathogens and target them for destruction or, in the case of Ig$\epsilon$, lead to an allergic response. Activated $T_C$ cells bind to infected body cells and kill them by directing programmed cell death (apoptosis) or perforin-mediated cell lysis.

Directions for Playing the Game

The following are preferred directions for the game. It is, however, possible to modify the game parameters to increase or decrease the speed of play, incentives and disincentives, game pieces, chance means, and the like without significantly affecting the concept game of the present invention. It is also an important aspect of the present invention that the content of the disease handout, and immune scenario vignettes, are true to contemporary medical knowledge. It is also important that the materials provide the pupil with material that is relevant and is at a level that is understandable to those educationally challenged in the area of immunology.

To begin the game each player or player group:

1. Receives a game piece, such as a flat disk with a distinctive marking, for example a colored stick-on label (blue, green, yellow, red, etc.). Each student also receives a "disease handout" (described herein) that includes a number of brief scenarios related to the diseases and allergies they have read about previously.
2. Each player rolls a die twice to determine what his or her blood type will be during the game. The sum of the two rolls will correspond to a specific blood type shown in the "transfusion table" on the game board. The blood type of each player in the group is recorded, and this list can be referred to during the game.
3. The players roll the die to determine who will go first. Order of play proceeds clockwise, beginning with the player who has rolled the highest number.
4. During the turn of each player, the player rolls the die and moves forward along the board the appropriate number of spaces. The number printed in each space corresponds to a specific scenario on the disease handout. The player reads the scenario and follows the directions given. In most cases, as a result of exposure to a specific pathogen, the player will receive a lymphocyte card, each one specific for the pathogen to which the player has been exposed. Hypothetical shapes representing certain bacterial and viral surfaces are shown on the game board. The lymphocytes on the card received after exposure to a particular antigen have receptors in a design that locks together with one particular antigen. Representative cards showing these hypothetical shapes are depicted in FIGS. 2A to 2M. After the player suffers the consequences given on the disease handout, the lymphocyte card serves as an indicator that the player has "memory" cells to protect the player if later exposed to the same pathogen.
5. If a player must go back to a medical facility or pharmacy, the players must place his or her game piece in the available space in that facility. If no space is available, the player must go back further (4–6 spaces back) to the "Rest" space crossed prior to that facility. Note that residing in a "Hospital" causes the player to lose a turn;

residing in a "Clinic" or "Pharmacy" does not cost the player a turn.

6. When nearing the finish line, one may roll a number that is more than the number of spaces available to move. In that case, the player advances one space during that turn.
7. The player who reaches the finish line first wins the game.

During the game, the players will observe that some diseases have more severe consequences than others. Some require recuperation in hospitals that cause the player to lose one turn. Other scenarios require only minor setbacks, e.g., going back several spaces to a clinic or pharmacy. However, any of the consequences may be increased when a hospital or clinic is full or when all the spaces in a pharmacy's parking lot are filled. In these situations, the player is required to go back further to the previous "Rest" space. Further, during the first 15–20 minutes of the game, there will be a rather slow progression toward the finish line, unless a person is lucky enough to land on "Rest" spaces during each turn. The tempo increases as the game progresses due to exposure to more pathogens. Such exposure causes the body to build up its immune system; this is evidenced by a growing collection of lymphocytes cards in the player's possession.

On occasion, a player may fall on a space that provides the player a free vaccination, or an opportunity to take a vaccination, against a specific pathogen. If the player chooses to take the vaccination, the player must go back to a clinic. This may be considered a setback, however, the setback is minimal compared to the consequence of getting the disease later in the game.

The game emphasizes several important points about the immune system. First, it illustrates specificity, i.e. the ability of a given lymphocyte to recognize only one specific antigen, and in this particular case a pathogen. Unless a player has been exposed to a particular pathogen, either through illness or vaccination, "memory" cells are not available to allow early recognition and destruction of that pathogen when contact occurs. Second, the "memory" characteristic of the immune system is demonstrated as players are able to progress along the game board at a faster pace as time passes due to the accumulation of more lymphocytes. Third, the consequence of not receiving a vaccination against a specific pathogen when given the chance is demonstrated when a player suffers a major setback due to exposure to that pathogen later in the game. Fourth, the ability of the immune system to cause damage to a person in the form of an allergic reaction is demonstrated by the consequences of coming into contact with certain allergy-causing substances.

The game board, as depicted in FIG. 1A, FIG. 1B, FIG. 1C and FIG. 1D, may be played as is shown or may be modified in an academic setting according to how a teacher may deem appropriate. For example, student players may be required to answer specific questions about a disease and/or disease-causing agent before they can proceed to their next turn. Since the game board contains only numbers, the disease handout can be modified to include diseases, disease models, or specific antigens and epitopes that are different from those listed herein, depending of the level of sophistication of the players.

It is also envisioned that other game concepts may be developed that may reinforce ideas and concepts related to other biological topics such as those relating to maternity and children (e.g. to teach expectant mothers about the importance of vaccinations during lae maze classes), more directly related to a particular disease, such as AIDS, or encompassing different phases of the immune response, such as primary and secondary immune responses.

Disease Handout

An important aspect of the invention lies in a handout delineating specific immune-scenarios that are the subject of the exercise. Examples of subject matters include information about a disease or disease model, and important characteristics of the immune response to the stated pathogen or disease condition.

A wide range of disease states may be included in the handout, including autoimmune responses, anaphylactic responses, graft rejection and immune deficiencies both inherited and acquired. It may also highlight interactions of the immune system with pathogens that mimic or take advantage of an immune response to propagate, thereby gaining entry into the host. Other disease states that can be the subject of handouts are different cancers. Another aspect of immune disease or of an immune state concerns those diseases wherein the host is rendered immunodeficient through aging or by a chemically induced immune deficiency, as in the case of radio- or chemo-therapy.

A wide variety of infectious disease pathogens are also potential subjects for disease handouts, including viruses, bacteria, fungi, and helminths. Infectious pathogens may include those that infect the host chronically and are opportunistic pathogens, or those that cause infectious disease.

Figure 3:
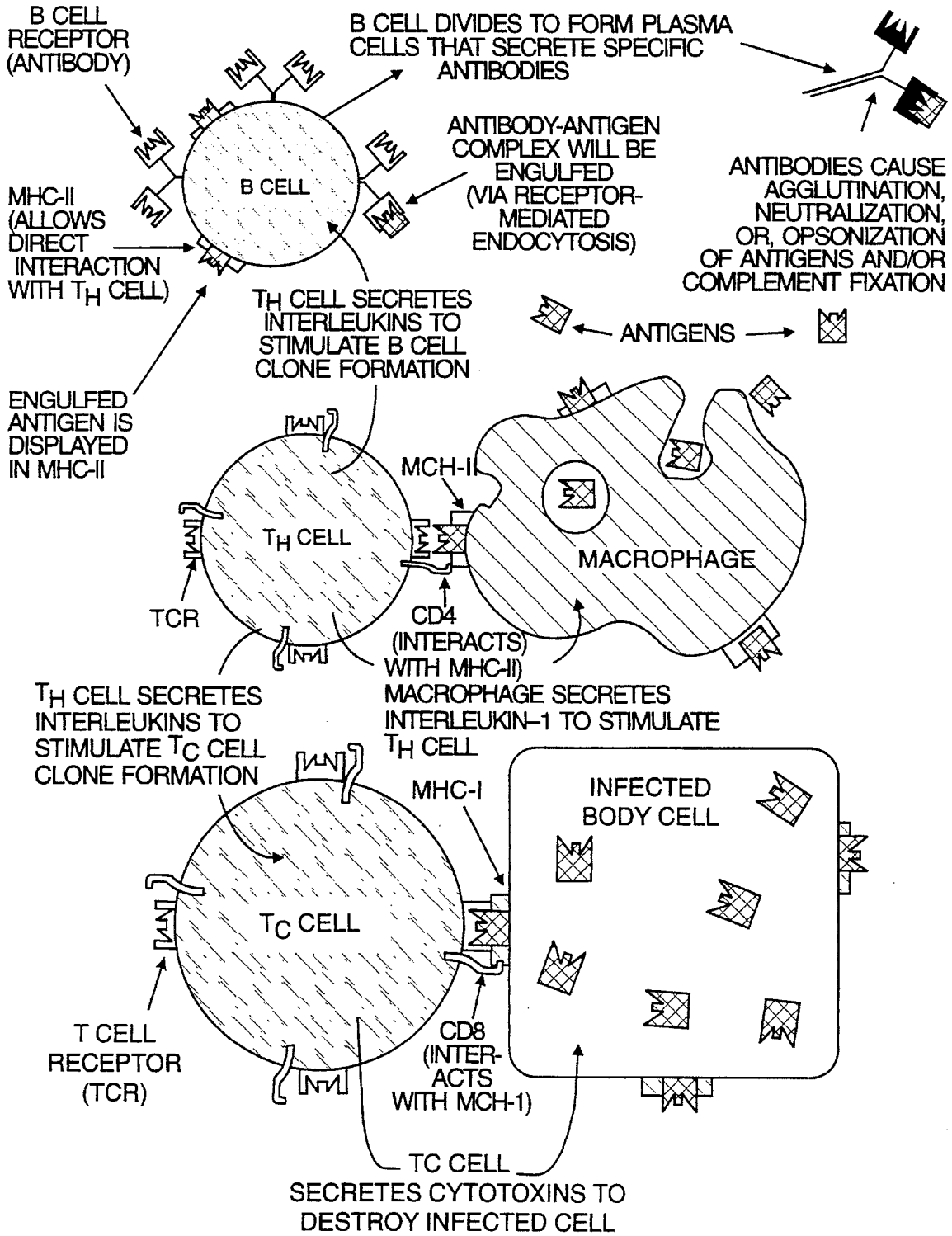
FIG. 3—Drawing summarizing the immune response, showing the interaction between macrophages, helper T ($T_H$) cells, and cytotoxic T ($T_C$) cells.
Figure 4A:
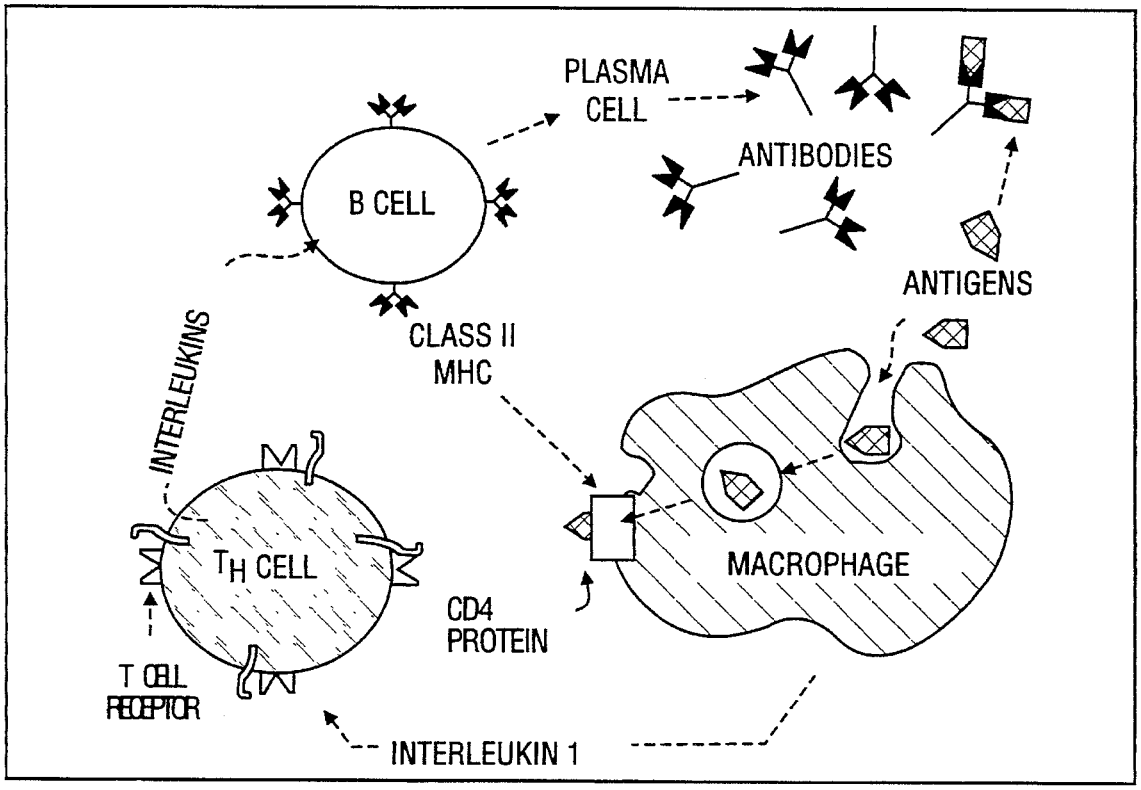
FIG. 4A, FIG. 4B, FIG. 4C, FIG. 4D, FIG. 4E, FIG, 4F, FIG. 4G, FIG. 4H, FIG. 4I, FIG. 4J, FIG. 4K, FIG. 4L, FIG. 4M—Cards showing hypothetical lymphocyte ($T_H$) receptor shapes encountered in the game, as in FIG. 2A to FIG. 2M, that further incorporate elements from the drawing depicted in FIG. 3 summarizing the immune response.
Figure 4B:
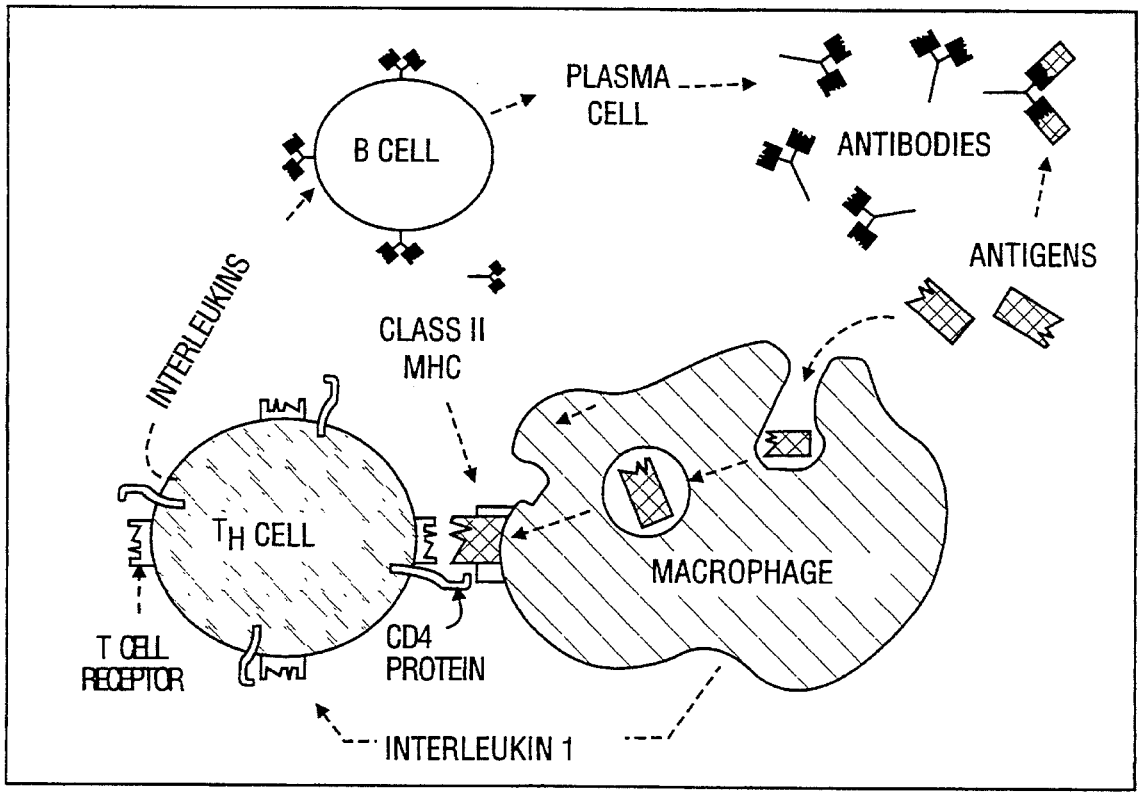
Figure 4C:
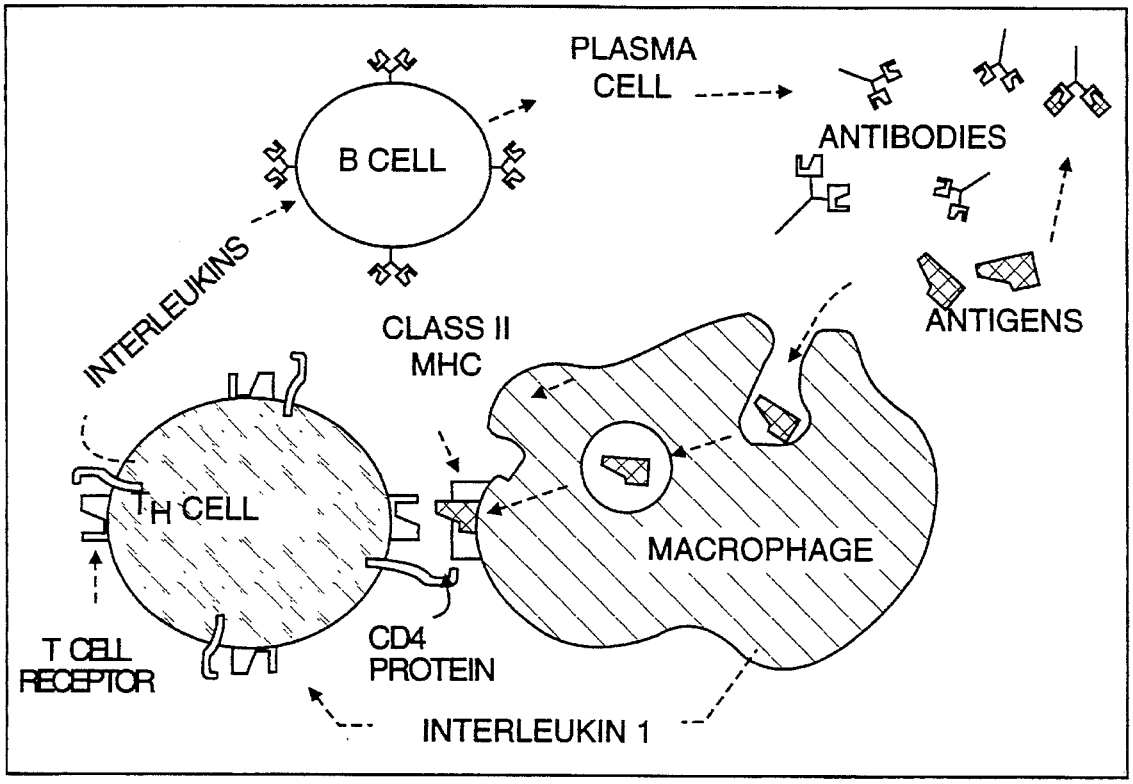
Figure 4D:
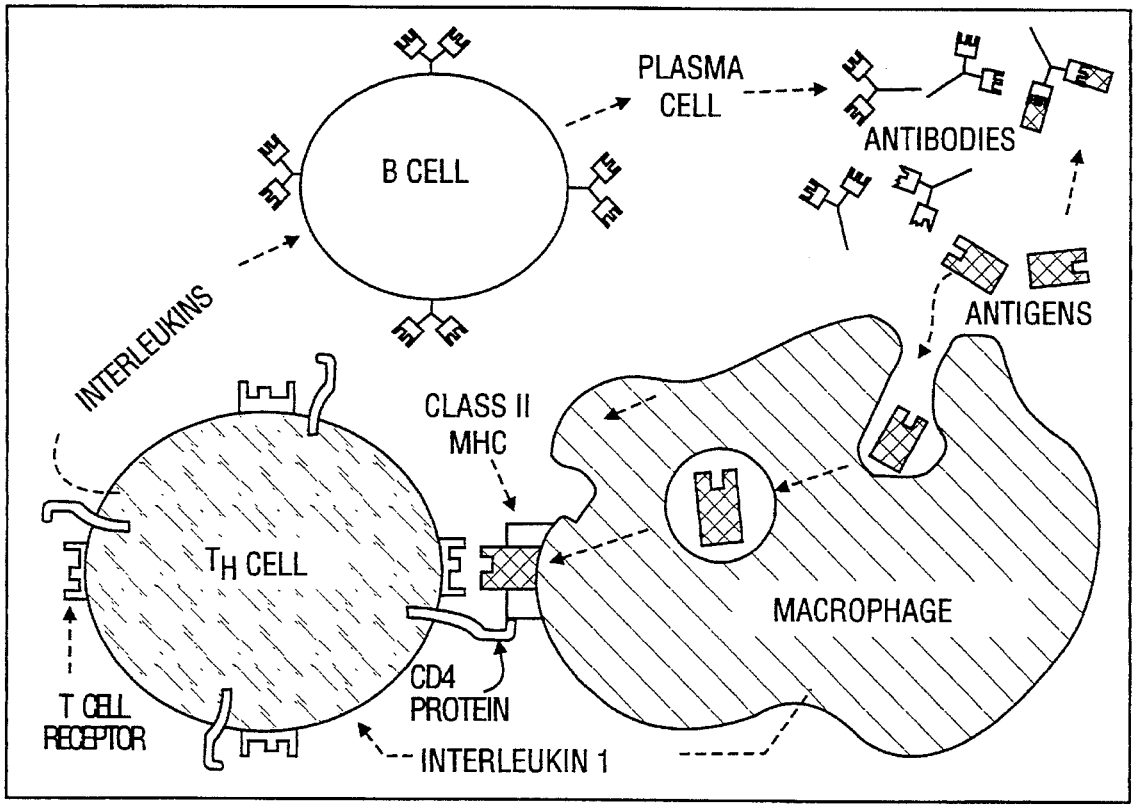
Figure 4E:
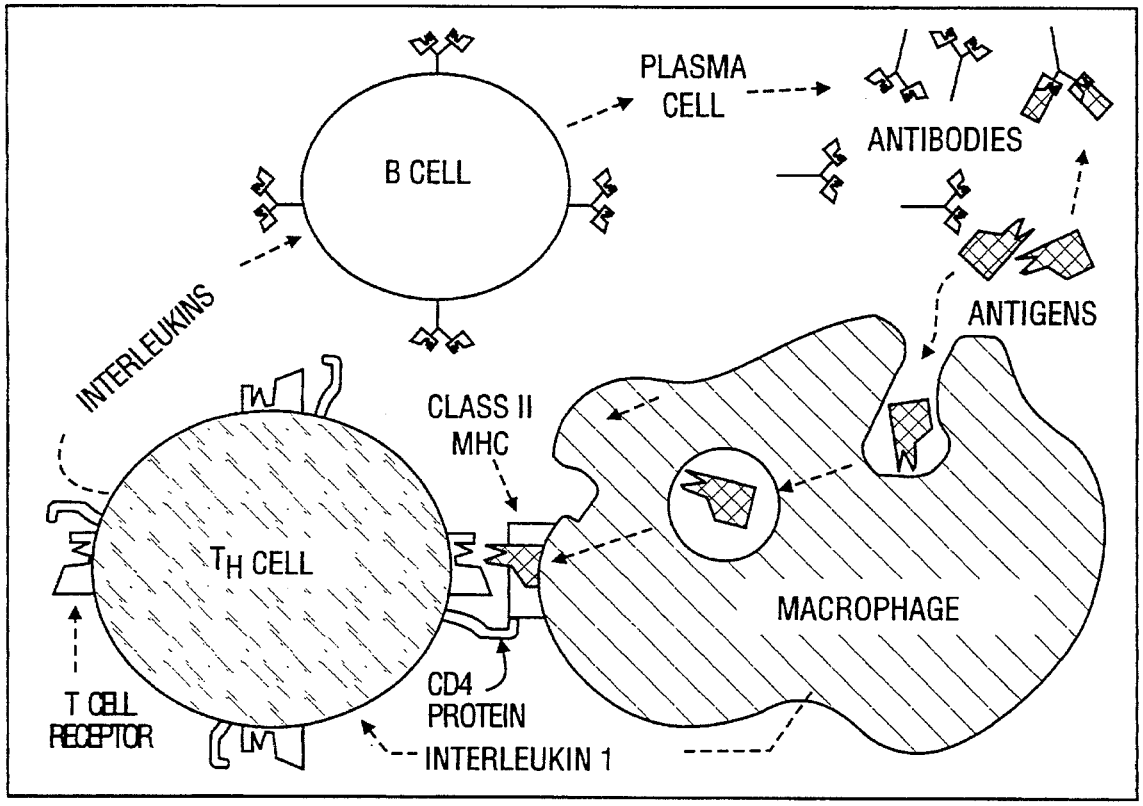
Figure 4F:
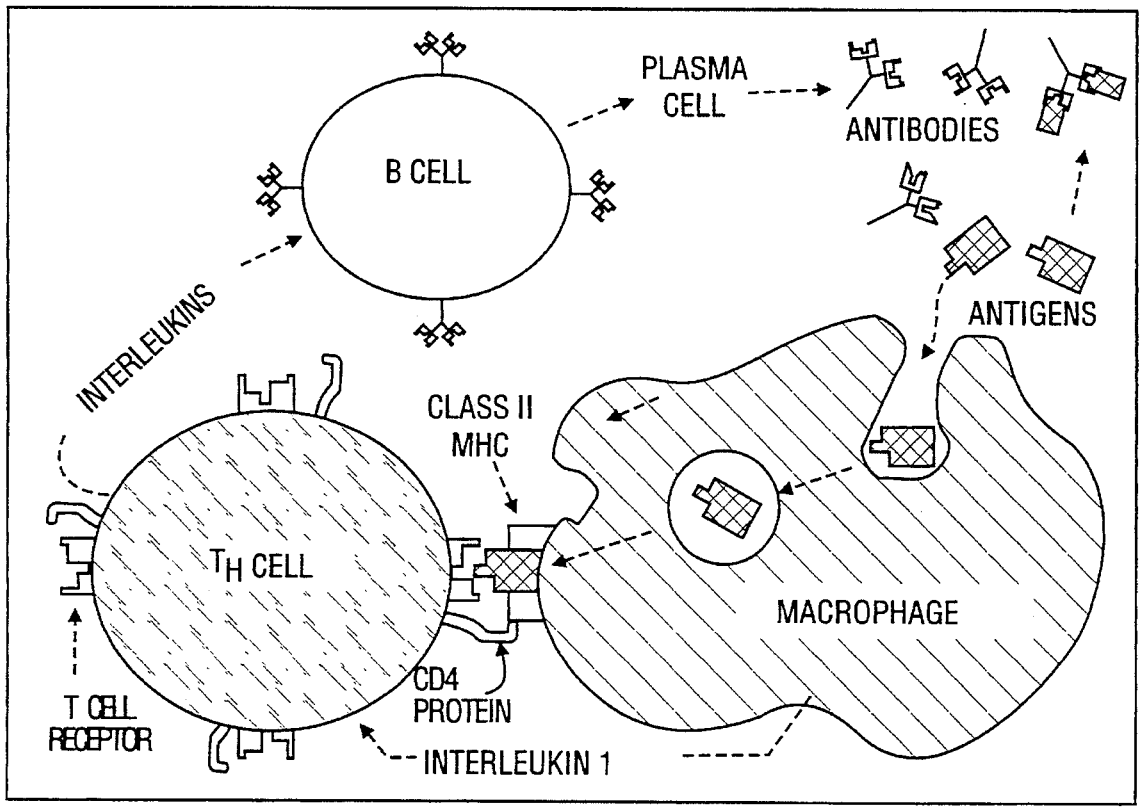
FIG. 4N—Depicts a "HIV" card, describing the actions a player must take upon landing on a space occupied by an individual having HIV.
Figure 4G:
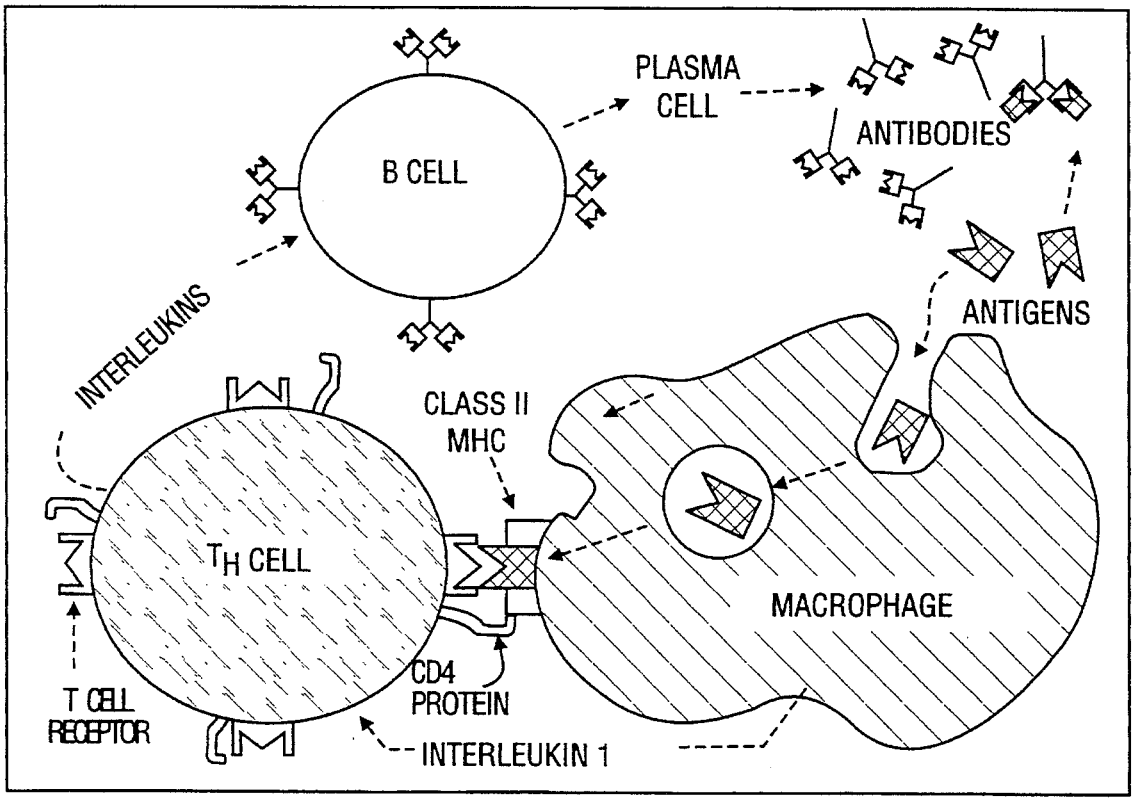
Figure 4H:
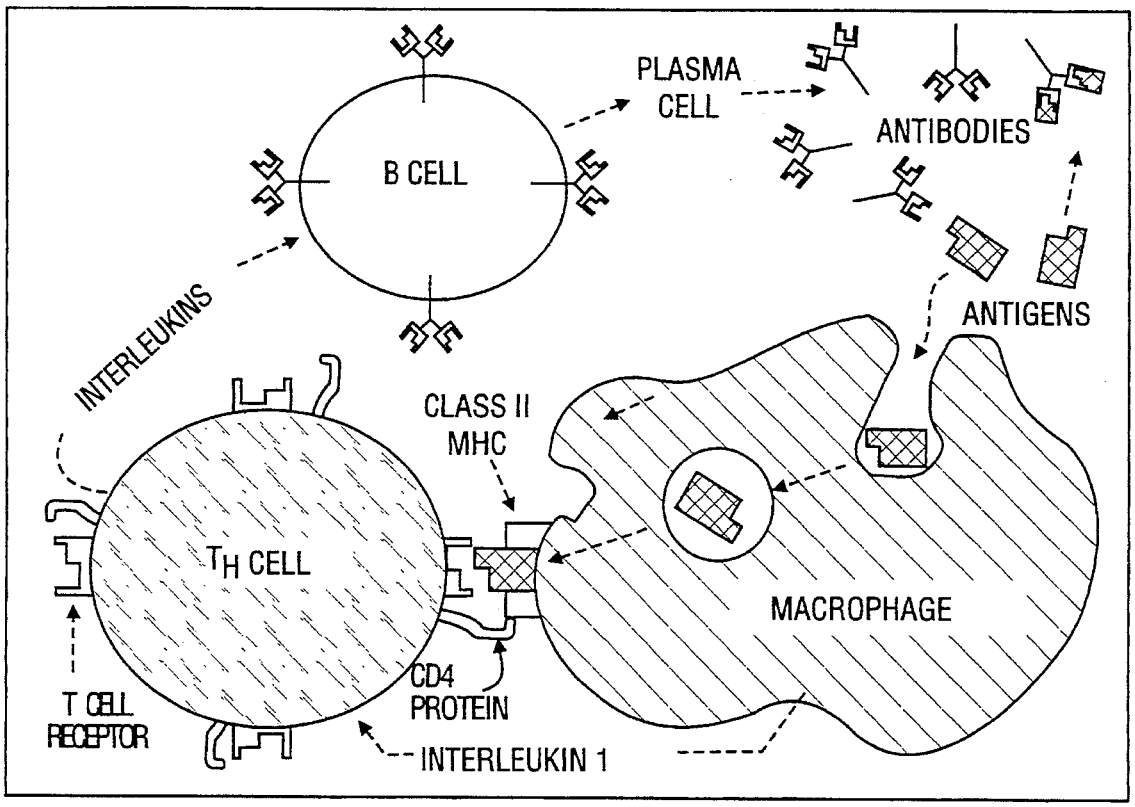
Figure 4I:
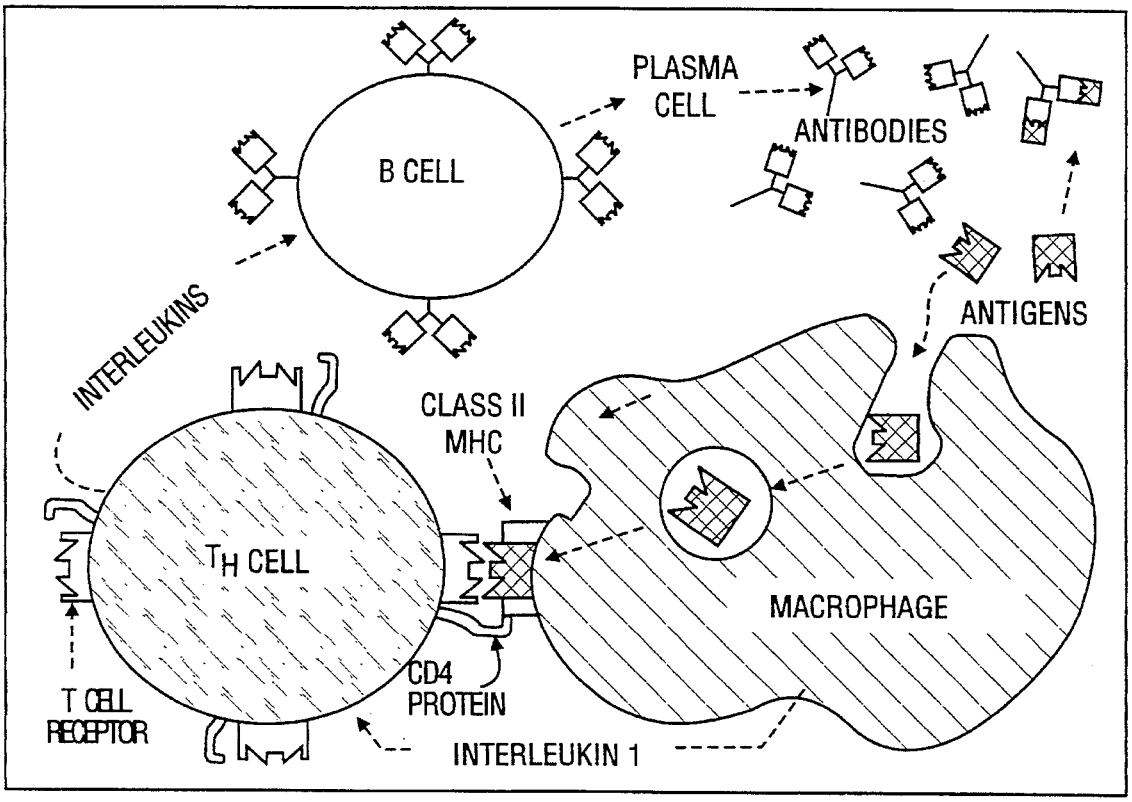
Figure 4J:
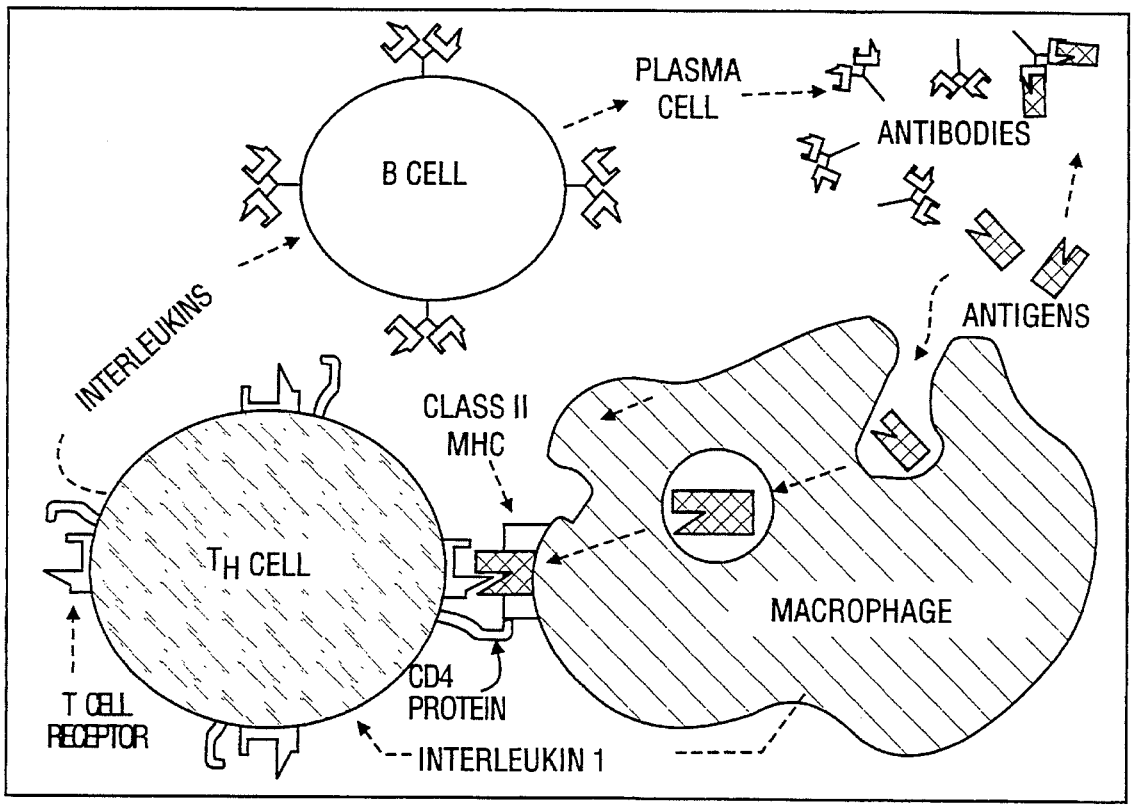
Figure 4K:
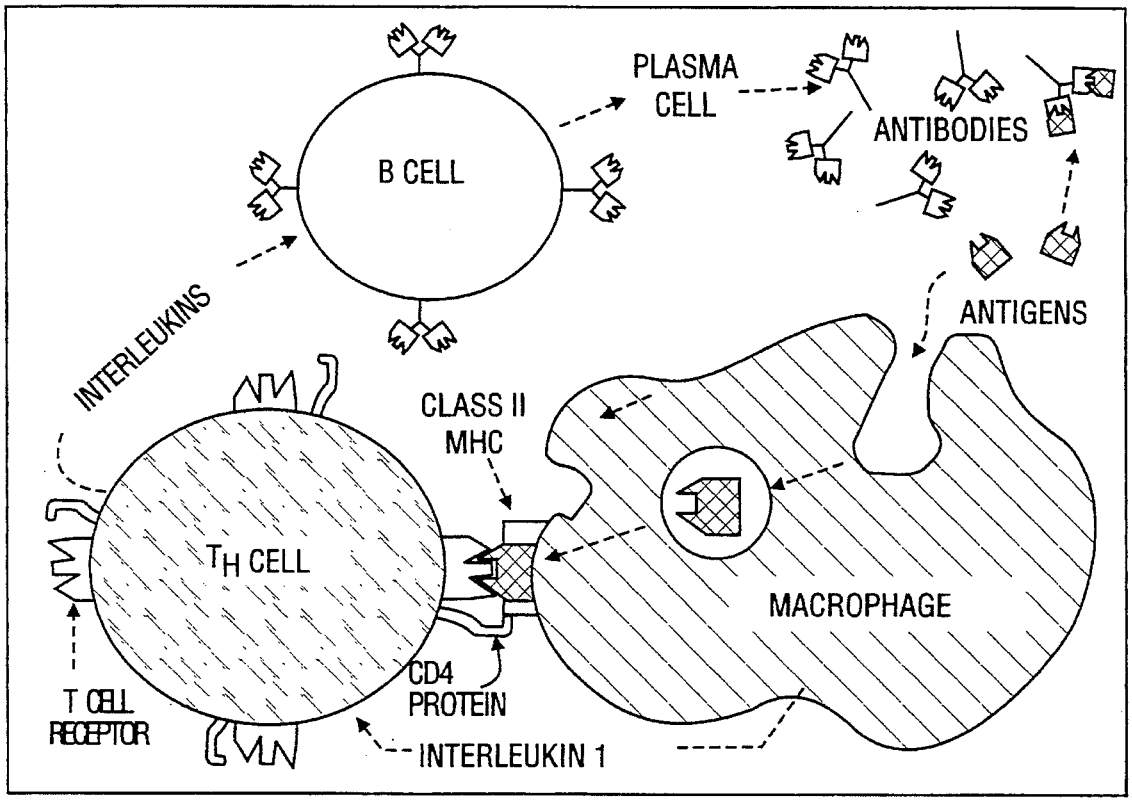
Figure 4L:
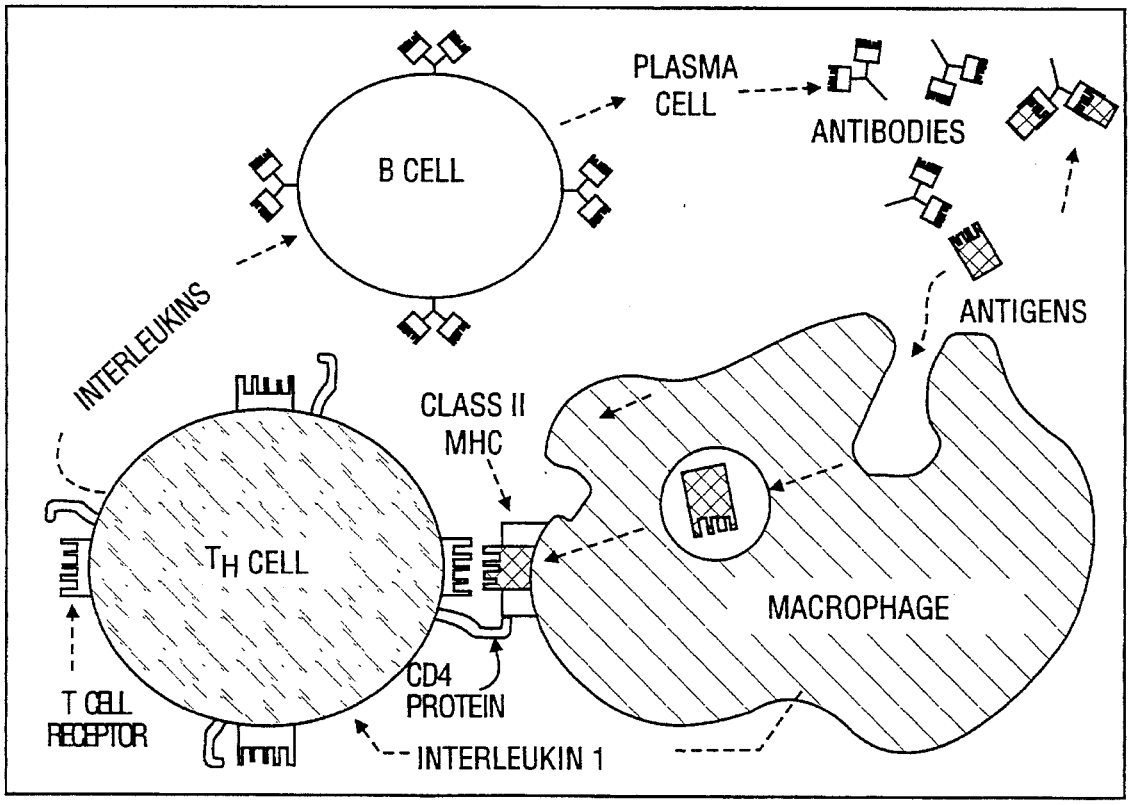
Figures 4M, 4N:
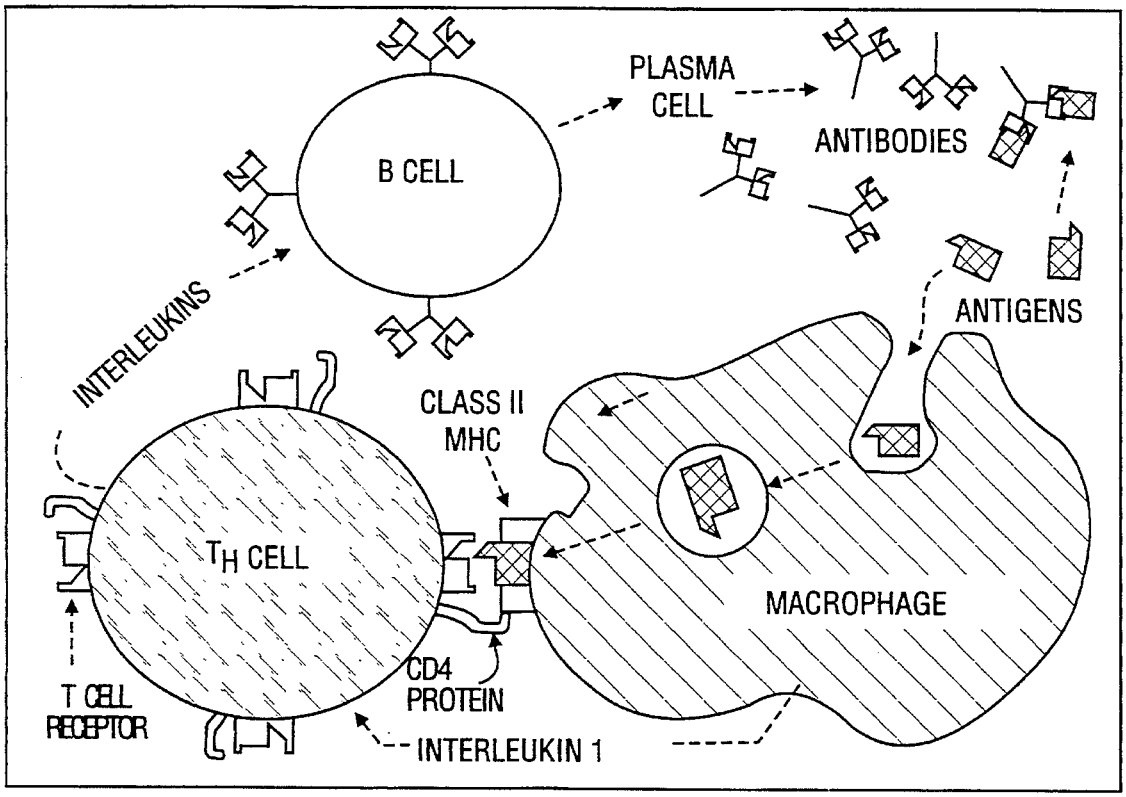

Another aspect of the disease handout may be a drawing that summarizes the immune response, and shows the interaction between macrophages, helper T ($T_H$) cells, and cytotoxic T ($T_C$) cells (FIG. 3). In alternative embodiments, this summary may be incorporated into each of the lymphocyte cards, as depicted in FIG. 4A to FIG. 4M.

Handout Example

AIDS: The HIV (Human Immunodeficiency Virus) invades helper T cells after binding to a specific molecule ($CD4^+$) on the cell's surface. As the infection progresses, the number of $T_H$ cells declines. Since these cells are necessary for stimulating both the humoral (antibody) and cellular immune responses, a decline in their number can lead to increasing difficulty in resisting other infectious agents. Finally, a patient develops AIDS, a disease characterized by inability to resist even the organisms that grow naturally in the body. Spread of this virus occurs through contact with infected body fluids such as blood and semen, since these fluids carry both free virus particles and infected $T_H$ cells. Due to the complex nature of this virus, no effective immunization procedure has been developed.

Animal Dander Allergy: When a person who is sensitive to animal dander inhales this substance, a reaction involving watery, itchy eyes and runny nose will occur. A sensitive person is one who has had a prior exposure to the dander that has caused the formation of IgE antibodies to occur. These antibodies bind to mast cells in the tissues and basophils in the blood. When the sensitized person is exposed to dander again, antigens from the dander will combine with the IgE and cause the mast cells and basophils to release chemical mediators that result in the allergic symptoms. Although no true vaccination is available, allergy "shots" are given in some cases to induce the formation of blocking IgG antibodies that can reduce the allergic reaction.

Bacterial Pneumonia: This disease is caused by a bacterium, *Streptococcus pneumoniae,* which is transmitted by infected respiratory droplets. Although healthy persons frequently don't contract the disease even when they are exposed to the organism, those who have had a recent viral respiratory infection, such as influenza, or those who have lowered resistance, are more susceptible. Specific antibodies are produced as a result of having pneumonia, or after immunization with a vaccine made with antigens from the capsule of the bacterium.

Bee Sting Allergy: If a person is allergic to bee venom, the mast cells in the person's tissues and the basophils in the blood have been previously sensitized to the allergen (bee venom) by the binding of specific IgE molecules to their surfaces. Now, the bee venom combines with those IgE molecules and causes the mast cells and basophils to undergo degranulation, allowing the release of chemicals that can cause anaphylaxis.

Blood Transfusion Reactions: The blood type of a person is determined by the presence or absence of certain carbohydrate antigens (A, B, or Rh) on the surface of red blood cells. If the "A: and "Rh" antigens are present, the blood is $A^+$, if only the B is present, the blood is $B^-$, if only the Rh is present, the blood is $O^+$, etc. The blood of each person contains antibodies against the antigens not present on his/her red blood cells. Therefore, an antigen and its specific antibody do not coexist in the same person. If an incompatible blood type is transfused into a recipient, antibodies in the recipient cause clumping and lysis of the transfused red cells.

Chickenpox: Chickenpox is a disease caused by a type of herpes virus called varicella virus. It is transmitted by infected airborne droplets. Although it initially infects the respiratory tract, this virus localizes in the skin after about two weeks to form vesicles filled with fluid. These rupture and form a scab before healing. Specific B lymphocytes are activated, with the aid of $T_H$ cells, and produce antibodies that attach to these specific virus particles to inactivate them and to protect a person from developing chicken pox if exposed to the virus again in the future. Cytotoxic T cells, also stimulated by helper T cells, help eliminate the virus by killing the body cells that are infected with virus.

Common Cold: The common cold can be caused by a number of different viruses including rhinoviruses and adenoviruses. These viruses, passed by the respiratory route, cause IgA antibodies to form. However, since there are at least 200 different agents that can cause the common cold, repeated infections are common. As people age, they contract fewer colds due to accumulated immunity during their lifetime. Occasionally, a cold can lead to some complications such as laryngitis and middle ear infection. No immunizations are available for the common cold.

Diphtheria: Diphtheria is a disease of the upper respiratory tract that is caused by a bacterium called *Corynebacterium diphtheriae*. The bacteria grow in the throat and produce a grayish membrane that can block the passage of air to the lungs. As they grow, the bacteria produce a toxin that circulates in the blood and damages the heart and kidneys, often leading to death if the patient is not treated with antibiotics. Antitoxin (IgG) forms that can neutralize the toxin. A vaccine consisting of an inactivated form of the toxin (toxoid) gives long-lasting immunity to this disease.

Food Allergy: A person can eat a piece of pecan pie at supper time and a specific chemical found in the pecans is thereby released in that person's GI tract. If the person has been sensitized, which means the presence of a specific IgE on the person's mast cells and basophils that can bind to this chemical, the complex of antigen, IgE, and cells causes the release of histamine and other chemicals that may result in a localized reaction or a systemic reaction called anaphylaxis.

Hepatitis B Virus: Hepatitis B virus is transmitted by infected blood or other body fluids such as semen, breast milk, and saliva, and can cause an acute form of liver disease that may or may not be noticeable. Although antibodies to the virus develop, the disease may become chronic and may lead to either cirrhosis or cancer of the liver. Recently, a genetically engineered vaccine has been developed that can prevent infection with this virus by inducing specific protective antibodies.

Influenza: The "flu" is caused by a virus that is spread from person to person by airborne droplets or by contact with contaminated hands or surfaces. Influenza virus replicates in cells of the respiratory tract to cause damage that can lead to complications such as bacterial pneumonia. Specific IgA antibodies block the binding of flu viruses to the respiratory cells; however, since these viruses frequently change their surface structure, new IgA antibodies need to be made each year by receiving a vaccine made from the latest strains.

Measles (Rubeola): Measles is an extremely infectious viral disease spread by infected respiratory droplets. Viruses first replicate in the respiratory tract and then spread through the blood to the skin and mucous membranes of the body including the conjunctiva. IgG antibodies form to inactivate the virus. Cytotoxic T cells interacting with virus-infected cells in the small blood vessels are the cause of the typical measles rash. Measles can be prevented by a highly effective, attenuated, live measles virus vaccine.

Mumps: Mumps is a viral disease characterized by swelling of the parotid glands and a general feeling of tiredness and loss of appetite. The virus is spread by respiratory droplets that enter the mouth and nose. During the disease, various antibodies form. Cytotoxic T cells also are present but their function in recovery from the virus is unclear. After recovery, the person has life-long immunity. There is also an attenuated live-virus vaccine given to young children.

Poison Ivy Allergy: An allergic reaction to poison ivy is caused when the ivy sap sensitizes a certain subgroup of T cells called $T_{DTH}$ cells. When these cells have subsequent exposure to the sap, they signal the migration of macrophages to the area where the skin was exposed. The macrophages and $T_{DTH}$ cells cause inflammation that is manifested as the typical rash of poison ivy. Once a person has become "sensitized," the person will continue to react upon exposure to the plant. The best way to prevent the rash is to avoid touching the plant or its sap.

Polio: Initially, polioviruses replicate in the cells of the throat and gastrointestinal tract where they rarely cause a serious problem. However, if they enter the blood and travel to the central nervous system, they can replicate and cause paralysis. Specific antibodies can block the transmission of polioviruses and prevent damage to the central nervous system. Immunization consists of either a killed-virus or live-virus vaccine, both of which give long-lasting immunity.

Pollen Allergy: If a person who is sensitive to a certain type of pollen inhales that pollen, an allergic reaction involving runny nose, sneezing, itching, and watery eyes will occur. To be sensitive, a person must have had a prior exposure to the pollen to allow IgE antibodies to form and attach to the surface of mast cells and basophils. Then when the sensitized person comes in contact with the pollen at another time, the pollen antigens combine with the bound IgE antibodies, which then cause the mast cells and basophils to release histamine and other chemical mediators that cause the allergic response to the pollen. In certain cases, immunization with the antigen can lead to the formation of IgG antibodies that block the allergic reaction.

Staphylococcal Infections: Although staphylococci are found normally on the human skin, and in the respiratory and gastrointestinal tracts, certain strains of staphylococci can cause a number of diseases. *Staphylococcus aureus* is a common cause of "staph" infections of the skin such as abscesses, acne, and impetigo. Antibodies that form against the organisms are not completely protective and a person may have repeated infections. The primary defense is a healthy phagocytic response.

Streptococcal Sore Throat: Pathogenic *Streptococcus pyogenes* living in the throat or nasal passages of an infected individual can be passed on to a healthy individual through sneezing, kissing, sharing eating utensils, etc. These bacteria can cause inflammation in the throat region known as strep throat or pharyngitis. Antibodies can form against a specific strain of *S. pyogenes;* however, since there are many different strains, a person may contract strep throat repeatedly.

Tetanus: If a person steps on a nail that has spores of the bacterium *Clostridium tetani* on its surface, the spores, which commonly are found in soil contaminated with animal feces, can germinate and multiply in the anaerobic environment of the injured tissue. As they grow, these bacteria release a toxin that acts on the nervous system to cause severe muscle spasms that can be fatal. Immunization with an inactivated form of the toxin (toxoid) can prevent these spasms by inducing the formation of specific IgG molecules that neutralize the toxin.

Tuberculosis: This disease, primarily of the lungs, is caused by a bacterium called *Mycobacterium tuberculosis,* and is transmitted by sputum droplets from an infected person. Once a person has been infected, both cellular immunity and delayed type hypersensitivity (DTH) develop. The DTH reaction involves $T_{DTH}$ cells that become sensitized by the antigens from the TB organism and then cause the migration of macrophages to the site of infection. In an otherwise healthy person, the $T_{DTH}$ and cytotoxic T cells confine the organism to the original site of infection. However, if the person is immunocompromised, as would be the case in an HIV-infected person, the organisms may spread and cause a systemic infection that can be life-threatening.

Whooping Cough (Pertussis): Whooping cough is caused by a bacterium called *Bordetella pertussis* that infects the respiratory tract from droplets spread when an infected patient coughs. The cough, called a "paroxysmal" cough, is so severe that it can lead to difficulty in breathing. A characteristic "whooping" sound occurs when the patient attempts to get his breath. After recovery, immunity is good due to the presence of IgG antibodies. A vaccine prepared from heat-inactivated whole bacteria is given regularly to young children to immunize them against this disease.

Playing the Game

The disease handout detailed hereinabove provides examples of diseases ranging from viral infection to chronologically-induced immune dysfunction. Disease handouts may be developed with differing levels of detail, subject matter and emphasis thereby tailoring the game to match the level and subject matter defined for the players.

A set of immune scenarios may be provided and numbered to correspond to the numbers located within a corresponding space. Of course, the subject matter will be encompassed within the materials disclosed in the disease handout previously provided to the player. The numbered descriptions in the following example have been written to match the diseases in the disease handout provided above. The example is provided to illustrate individual immune scenarios or vignettes of a game, but are not limited to the subject matter maintained therein. The numerals in the example are the same as the numerals of the spaces on the game board to which they pertain.

EXAMPLE

1. You have had contact with someone who is infected with the varicella (chickenpox) virus. Show your lymphocyte card that can interlock with this virus. If you do not have the card, you get chickenpox and must go back to a "Rest" space and obtain it.
2. You get to take a free flu shot that causes you to make the specific lymphocyte card for influenza A virus. Obtain the specific lymphocyte card for influenza A.
3. You have been exposed to the influenza A virus. Show your lymphocyte card that can interlock with influenza A. If you do not have the card, go back to the nearest hospital or clinic (if a room space is available) or the "Rest" space at least 5 spaces back from that medical facility and obtain the specific card.
4. You get to take a free vaccination against poliovirus. This causes you to make the specific lymphocytes that recognize the virus. Obtain the specific lymphocyte card.
5. You have come in contact with *Corynebacterium diphtheriae.* Show your lymphocyte card that can interlock with this bacterium; otherwise, you just came down with diphtheria and must go back to the nearest "Hospital" (if a room space is available) or to the "Rest" space at least 5 spaces back from that hospital and obtain the card.
6. If you want to receive a tetanus vaccination, go back to the "Clinic" (if a room space is available) arid obtain the specific lymphocyte card that interlocks with the bacterium *Clostridium tetani.*
7. You have come in close contact with someone who is infected with the (rubeola) measles virus. Show your lymphocyte card that interlocks with rubeola. If you do not have the card, go back to the nearest clinic or hospital (if a room space is available) or the "Rest" space at least 5 spaces back from that medical facility and obtain the card.
8. There has been another outbreak of mumps at the local junior high school where you work. Show your lymphocyte card that can interlock with this virus; otherwise, you get mumps with complications and must go back to the nearest medical facility (if a room space is available), or the "Rest" space at least 5 spaces back from that facility. There you can obtain the specific lymphocytes.
9. You are allergic to poison ivy. If you rolled a 4, 5, or 6 to get to this space, you accidentally rubbed against some poison ivy vines, and must go back to the "Clinic" (if a room space is available) or "Pharmacy" (if parking space is available) or the "Rest" space at least 5 spaces back from that facility for medication. Try not to scratch.
10. Show your lymphocyte card that interlocks with influenza A; otherwise, you get the flu (from a virus) that eventually develops into pneumonia caused by the bacterium *Streptococcus pneumoniae.* Go back to the "Hospital" (if a room space is available) or the "Rest" space at least 5 spaces back from the hospital and obtain the lymphocytes for protection against influenza A.
11. If you rolled a 4, 5, or 6 to get to this space, your subcutaneous tissues have become infected with a pathogenic strain of Staphylococcus bacteria after getting a cut on your finger. For this infection, antibiotics are required and you must go back to the nearest clinic or hospital (if a room space is available) or "Rest" space at least 5 spaces back from that facility.
12. If you just rolled a 2 or 6 to get to this space, you have come in contact with HIV. Obtain an "HIV" card and place it in your corner of the game board. You must give up at least half of your lymphocyte cards (player's choice of cards) every time you pass a "Clinic" or "Hospital" that you have not passed before. Since there are only 2 HIV cards per game, no more than 2 players will have HIV during the game.

13. If you occupy this space at the same time as a person who has HIV, you become infected with the virus and must obtain an "HIV" card, unless both HIV cards are taken. If you already have HIV, any person occupying this space with you gets HIV also, and must obtain an "HIV" card if available. No more than 2 players will have HIV during the game.

14. If you rolled a 4, 5, or 6 to get to this space, you have inhaled some animal dander to which you are allergic and must go back to the "Clinic" (if a room is available) or "Pharmacy" (if parking is available) or "Rest" space at least 5 spaces back from that facility.

15. You set up a tent in a hayfield and are exposed to a variety of pollen. If you rolled a 4, 5, or 6 to get to this space, you are allergic to one specific type and must go back to the "Pharmacy" (if a parking space is available) or "Clinic" (if a room space is available) or "Rest" space at least 5 spaces back from that facility.

16. If you rolled a 3, 4, or 5 to get to this space, you accidentally ate a food item to which you are allergic and must go back to the nearest clinic or hospital (if a room space is available) to be treated for anaphylaxis. Alternative: go back to the "Rest" space at least 5 spaces back from that facility.

17. You have been in close contact with a person who has TB. If you rolled a 3, 4, or 5, your TB test is positive and you must go back to the "Hospital" (if a room space is available) and get a chest X-ray to determine the progress of your infection and to take anti-TB medication. Alternative: go back to the "Rest" space at least 5 spaces back from that hospital.

18. If you rolled a 2, 3, or 4 to get to this space, then you just had another car accident. First, go back to the nearest clinic or hospital to get a blood transfusion. If that facility is full, go back to the "Rest" space at least 5 spaces back from that facility. Second, follow the instructions on the "Blood Transfusions" table. If you roll an incompatible type, go back to the "Rest" space at least 5 spaces back from where you were located when you rolled the die for the transfusion.

19. You have the chance to get a vaccination against the bacterium *Corynebacterium diphtheriae*. If you want the vaccine, go back to the "Clinic" (if a room is available) and obtain the specific lymphocyte card. If you do not take the vaccine, stay where you are.

20. You have come into contact with poliovirus. Show your lymphocyte card for polio. If you do not have the card, you contract polio and must go back to the "Hospital" (if a room space is available) or "Rest" space at least 5 spaces back from that facility. There you can obtain the specific card.

21. You have the option to take a vaccination for measles virus. If you want the vaccine, go back to the "Clinic" (if a room space is available) and obtain the lymphocyte card.

22. You stepped on a nail contaminated with spores from the bacterium *Clostridium tetani*. Show your lymphocyte card for tetanus; otherwise, you begin to feel the effects of tetanus and must go back to the "Hospital" (if a room space is available) or "Rest" space at least 5 spaces back from that facility. There you can obtain the specific lymphocyte card.

23. You have been infected with rhinovirus 13 that causes the common cold syndrome. Show your lymphocyte card for this virus; otherwise, go back to a "Pharmacy" (if a parking space is available) or "Clinic" (if a room space is available) for medication, or to the "Rest" space at least spaces back from that facility. Obtain the specific lymphocyte card for this strain of virus.

24. You have been infected with a rhinovirus 79 that causes the common cold syndrome. Show your lymphocyte card for this virus. If you do not have the card, go back to an available "Pharmacy" (if a parking space is available) or "Clinic" (if a room space is available) for medication, or go back to the "Rest" space at least 5 spaces back from that facility since you develop complications. Obtain the lymphocyte card that interacts with rhinovirus 79.

25. You have been infected with Adenovirus 8, which can cause the common cold syndrome. Show your lymphocyte card that interlocks with this virus. If you do not have it, go back to "Pharmacy" (if a parking space is available) or "Clinic" (if a room space is available) for medication, or go back to the "Rest" space at least 5 spaces back from that facility. Obtain the specific lymphocyte card that interacts with adenovirus 8.

26. You have been infected with rhinovirus 94, which can cause the common cold syndrome. Show your lymphocyte card that can interlock with this virus; otherwise, go back to an available "Pharmacy" (if parking space is available) or "Clinic" (if room space is available) for medication, or go back to the "Rest" space at least 5 spaces back from that facility. Obtain the specific lymphocyte card for this virus.

27. If you want to get a pertussis vaccination, go back to the clinic (if room space is available) and get the specific lymphocyte card that can interlock with the *Bordetella pertussis* bacterium.

28. You have been working in a nursery taking care of infants, one of which has pertussis (whooping cough). Show your lymphocyte card that can interlock with the pertussis bacterium. If you do not have it, go back to the "Hospital" (if room space is available) or "Rest" space at least 5 spaces back from that hospital while you get the specific lymphocyte card.

29. You have the option to get a hepatitis B vaccination. If you take the vaccine against this virus, go back to the "Clinic" (if room space is available) and obtain the specific lymphocyte card that can interlock with the hepatitis B virus.

30. While working in a clinic, you accidentally stick yourself with a needle contaminated with the blood of a patient who has hepatitis B virus (HBV). Show your lymphocyte card that can interlock with this virus. If you do not have the card, go back to the "Hospital" (if room space is available) or the "Rest" space at least 5 spaces back from the hospital to get the card.

31. You have the chance to be immunized against the mumps virus. If you take the vaccine, go back to the "Clinic" (if room space is available) so that you can get the lymphocyte card that interlocks with this virus.

32. Someone who has one of the many pathogenic strains of *Streptococcus pyogenes* living in their oronasal cavity just sneezed on you. If you rolled a 4, 5, or 6 to get to this space, you are not immune to this strain. As a result, you get another case of "strep throat" and must go back to the nearest "Hospital" or "Clinic" (if room space is available), or the "Rest" space at least 5 spaces back from that facility.

33. You are allergic to bee venom, but enjoy working with flowers. If you rolled a 3, 4, or 5 to get to this space, you have been stung by a disturbed honeybee and must go back to a "Hospital" or "Clinic" (if room space is available) or the "Rest" space at least 5 spaces back from that facility to get some epinephrine to prevent anaphylaxis.
34. If you rolled a 5 or 6 to get to this space, you were given a blood transfusion from the player on your left. If you can receive it safely, stay where you are. If that blood cannot be given to you safely, go back to the "Hospital" (if room space is available) or the "Rest" space at least 5 spaces back from that hospital for further treatment. If the blood you received has the HIV, you must obtain an "HIV" card (if one is available). (No more than 2 players will have the HIV).
35. The player to your right needs a blood transfusion. If you can donate blood to that person, move ahead to the next "Rest" space.
36. If you rolled a 4, 5, or 6 to get to this space, you were given a blood transfusion from the player on your right. If that blood cannot be given to you safely, go back to the nearest "Hospital" (if room space is available) or the "Rest" space at least 5 spaces back from that hospital for further treatment. If the blood you received has the HIV, you must obtain an "HIV" card (if one is available). (No more than 2 players will have the HIV).
37. If you can donate blood to the player on your left, you have the potential to save that person's life and can move ahead to the next "Rest" space. If you cannot donate blood to this person, stay where you are.
38. You were given a blood transfusion during recent surgery in a foreign country that did not adequately screen blood samples. If you rolled a 1 or 2 to get to this space, that transfused blood was contaminated with HIV and you must obtain an "HIV" card.
39. If you rolled a 4, 5, or 6 to get to this space, your immune system has failed to recognize and destroy some cancerous cells in your body. You may recover, but that recovery will require some time. Go back to the nearest "Hospital" (if room space is available) or the "Rest" space at least 5 spaces back from that hospital and recover from this episode.

The apparatus and methods disclosed and claimed herein may be made and executed without undue experimentation in light of the present disclosure. While the apparatus and methods of this invention have been described in terms of preferred embodiments, it will be apparent to those of skill in the art that variations may be applied to the apparatus, methods and in the steps or in the sequence of steps of the method described herein without departing from the concept, spirit and scope of the invention. All substitutes and modifications apparent to those skilled in the art are deemed to be within the spirit, scope and concept of the invention as defined by the appended claims.

REFERENCES

The following references, to the extent that they provide exemplary procedural or other details supplementary to those set forth herein, are specifically incorporated herein by reference.

Benjamini, E. and S. Leskowitz. (1991). *Immunology: A Short Course.* Second edition. New York: John Wiley & Sons, Inc.

Brock et al. (1994). *Biology of Microorganisms.* Seventh edition. Englewood Cliffs, N.J.: Prentice Hall.

Books et al. (1991). *Jawetz, Melnick & Adelberg's Medical Microbiology.* 19th edition. East Norwalk, Conn.: Appleton & Lange.

Joklik et al. (1992). *Zinsser Microbiology.* Twentieth edition. East Norwalk, Conn.: Appleton and Lange.

Prescott et al. (1993). *Microbiology.* Second edition. Dubuque, Iowa: Wm. C. Brown Publishers.

Tizard I. R. (1992) *Immunology: An Introduction.* Third edition. Orlando, Fla.: Saunders College Publishing.

Tortora et al. (1992). *Microbiology: An Introduction.* Fourth edition. Redwood City, Calif.: The Benjamin/Cummings Publishing Company, Inc.

What is claimed is:

1. A board game apparatus for teaching the immune system to players of the game comprising:

a playing board having a continuous main course divided into a sequence of playing spaces, a first portion of said playing spaces having numbers in a random order with a single said number printed in each space, a second portion of the spaces being rest spaces with each rest space associated with a health facility, a start space and a finish space;

a chance device actuable by a player to determine the number of said playing spaces to be moved by the player;

a plurality of distinctive tokens constituting playing pieces, a separate one of said playing pieces to be utilized by a separate one of the players playing in the game;

a disease handout comprising a list of diseases and allergies that involve the immune system, with descriptions of the diseases and allergies and the types of immune response mounted against the diseases if so applicable;

a plurality of cards, each corresponding to a helper T cell with a specific receptor shape that can interlock with a separate bacterial or viral pathogen associated with a disorder listed in said handout; and a set of numbered immune scenarios, each said scenario having a number corresponding to the number of a separate said playing space and relating its corresponding said playing space to a specific disease or allergy in said handout.

2. The apparatus according to claim 1 wherein the main course has the general shape of an immunologically active molecule.

3. The apparatus according to claim 1 wherein the main course has the general shape of an antibody.

4. The apparatus according to claim 1, which further comprises a table on the playing board listing different blood types and indicia relating each said type with a separate number selectable by said chance device.

5. The apparatus according to claim 1, wherein the main course has the shape of an IgG molecule.

6. The apparatus according to claim 1, wherein the main course has the shape of an IgM molecule.

7. The apparatus according to claim 1, wherein the chance device comprises a rotatable pointer.

8. The apparatus according to claim 1, wherein the chance device comprises at least one die.

9. The apparatus according to claim 1, wherein the board surface is further provided with diagrams showing hypothetical shapes representing certain bacterial and viral surfaces.

10. The apparatus according to claim 1, wherein the playing spaces are of different colors.

11. The apparatus according to claim 1, wherein the disease handout further comprises a drawing that summarizes the immune response.

12. The apparatus according to claim 1, wherein the receptor shapes are three dimensional, and can interlock with three dimensional shapes that correspond to the separate bacterial or viral pathogens.

13. The apparatus according to claim 12, wherein the three dimensional shapes corresponding to the separate bacterial or viral pathogens are attached to the game board.

14. A method of teaching persons about immunology using the apparatus of claim 1, the method comprising:

assigning each person a separate token;

actuating the chance device to determine the order of play;

actuating the chance device during a first turn for each person to determine the number of the playing spaces for the person to advance to from a starting point at one end of the main course;

advancing along the adjacent playing spaces according to the number generated by the chance device; and finishing the game by landing on a finish space.

15. The method according to claim 14, wherein the player's blood group is determined by use of the chance device.

16. The method according to claim 14, wherein a situation is provided allowing a winning player or group of players to receive special credit.

* * * * *

UNITED STATES PATENT AND TRADEMARK OFFICE

CERTIFICATE OF CORRECTION

PATENT NO. : 5,556,100

DATED : September 17,1996

INVENTOR(S) : Taylor et al.

It is certified that error appears in the above-identified patent and that said Letters Patent is hereby corrected as shown below:

On the title page: Item [57], line 9, delete "A method" and insert --A means-- therefor.

Claims,

In claim 10: Column 16, line 64, delete "are of different" and insert --may be of different-- therefor.

Signed and Sealed this

Twenty-seventh Day of May, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,556,100

DATED : September 17, 1996

INVENTOR(S) : Taylor et al

It is certified that error appears in the above-identified patent and that said Letters Patent is hereby corrected as shown below:

This certificate supersedes Certificate of Correction issued May 27, 1997, the number was erroneously mentioned and should be deleted since no Certificate of Correction was granted.

Signed and Sealed this

Tenth Day of February, 1998

Bruce Lehman

*Attest:*

BRUCE LEHMAN

*Attesting Officer*

*Commissioner of Patents and Trademarks*